US011530861B2

(12) United States Patent
Kim et al.

(10) Patent No.: US 11,530,861 B2
(45) Date of Patent: Dec. 20, 2022

(54) REFRIGERATOR AND CONTROL METHOD THEREOF

(71) Applicant: LG ELECTRONICS INC., Seoul (KR)

(72) Inventors: Kwangsik Kim, Seoul (KR); Aejin Byun, Seoul (KR); Chungill Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 100 days.

(21) Appl. No.: 16/638,564

(22) PCT Filed: Jul. 31, 2018

(86) PCT No.: PCT/KR2018/008677
§ 371 (c)(1),
(2) Date: Feb. 12, 2020

(87) PCT Pub. No.: WO2019/035576
PCT Pub. Date: Feb. 21, 2019

(65) Prior Publication Data

US 2020/0217573 A1 Jul. 9, 2020

(30) Foreign Application Priority Data

Aug. 17, 2017 (KR) ..... 10-2017-0103974

(51) Int. Cl.
*F25C 5/20* (2018.01)
*F25C 1/24* (2018.01)
(Continued)

(52) U.S. Cl.
CPC ..... *F25C 5/22* (2018.01); *F25C 1/24* (2013.01); *F25C 5/04* (2013.01); *F25C 5/185* (2013.01)

(58) Field of Classification Search
CPC .... F25C 5/22; F25C 5/04; F25C 5/185; F25C 1/24; F25C 5/046; F25C 5/182;
(Continued)

(56) References Cited

U.S. PATENT DOCUMENTS

2003/0197080 A1* 10/2003 Karkos, Jr. ..... H02K 21/24 241/92
2011/0146324 A1 6/2011 Lee et al.
(Continued)

FOREIGN PATENT DOCUMENTS

CN 101499756 8/2009
CN 101592426 12/2009
(Continued)

OTHER PUBLICATIONS

Translation of KR20090124886. Shinohara et al . . . Dec. 3, 2009, Paragraph 24. (Year: 2009).*
(Continued)

*Primary Examiner* — Cassey D Bauer
*Assistant Examiner* — Birhanu Damtew Weldetensi
(74) *Attorney, Agent, or Firm* — KED & Associates, LLP

(57) ABSTRACT

A refrigerator includes: an ice maker for generating ice; an ice bin for storing the ice and including a rotational blade that is rotated in order to discharge the ice; a motor for generating power for rotating the rotational blade; a manipulation pad provided on the door of the refrigerator and manipulated to discharge the ice from the ice bin; a manipulation sensing part for detecting the manipulation of the manipulation pad; and a controller for operating the motor when the manipulation of the manipulation pad is detected by the manipulation sensing part, wherein the controller rotates the motor in one direction to discharge the ice from the ice bin and the controller rotates the motor in the other direction, which is the opposite direction of the one direc-
(Continued)

tion, for a set period of time when the manipulation of the manipulation pad is no longer detected.

13 Claims, 21 Drawing Sheets

(51) Int. Cl.
*F25C 5/04* (2006.01)
*F25C 5/185* (2018.01)

(58) Field of Classification Search
CPC ..... F25C 2400/10; F25C 2500/08; F25C 2600/04; F25C 2700/08; F25C 2700/10
See application file for complete search history.

(56) References Cited

U.S. PATENT DOCUMENTS

| | | | | |
|---|---|---|---|---|
| 2014/0182315 | A1* | 7/2014 | Kim ..... | F25C 5/187 62/73 |
| 2017/0261252 | A1 | 9/2017 | Son et al. | |

FOREIGN PATENT DOCUMENTS

| | | | |
|---|---|---|---|
| CN | 102102930 | | 6/2011 |
| CN | 103166181 | | 6/2013 |
| CN | 103448863 | | 12/2013 |
| JP | 2010060191 | A * | 3/2010 |
| JP | 5094647 | B2 * | 12/2012 |
| KR | 1998-0045568 | | 9/1998 |
| KR | 10-0239996 | | 1/2000 |
| KR | 10-2001-0055667 | | 7/2001 |
| KR | 10-2006-0033528 | | 4/2006 |
| KR | 10-0633126 | | 10/2006 |
| KR | 10-2009-0124886 | | 12/2009 |
| KR | 20090124886 | A * | 12/2009 |
| KR | 10-2013-0123719 | | 11/2013 |
| KR | 10-2014-0088693 | | 7/2014 |
| KR | 10-1618552 | | 5/2016 |
| KR | 10-1631322 | | 6/2016 |
| TW | 200949177 | | 12/2009 |
| WO | WO 2016/036213 | | 3/2016 |

OTHER PUBLICATIONS

English translation of KR-20090124886-A translation date Dec. 3, 2021. (Year: 2021).*
Englkidh trsnslation of JP-2010060191-A, translation date Dec. 15, 2021 (Year: 2021).*
JP-5094647-B2 , Hikichi T. translated on Mar. 2022 (Year: 2012).*
Australian Office Examination Report dated Nov. 30, 2020 issued in Application No. 2018318603.
International Search Report dated Nov. 14, 2018 issued in Application No. PCT/KR2018/008677.
European Search Report dated Apr. 8, 2021 issued in Application No. 18845877.2.
Chinese Office Action dated Feb. 3, 2021 issued in Application No. 201880053229.8.
Chinese Office Action dated Aug. 25, 2021 issued in Application No. 201880053229.8.
Korean Office Action dated Nov. 3, 2022 issued in Application No. 10-2020-7002615.

* cited by examiner

REFRIGERATOR AND CONTROL METHOD THEREOF

CROSS-REFERENCE TO RELATED PATENT APPLICATIONS

This application is a U.S. National Stage Application under 35 U.S.C. § 371 of PCT Application No. PCT/KR2018/008677, filed Jul. 31, 2018, which claims priority to Korean Patent Application No. 10-2017-0103974, filed Aug. 17, 2017, whose entire disclosures are hereby incorporated by reference.

TECHNICAL FIELD

The present invention relates to a refrigerator and a method for controlling the same.

BACKGROUND ART

Generally, a refrigerator is a device for storing food in a low temperature state by low temperature air.

The refrigerator may include a cabinet in which a storage compartment is provided and a refrigerator door that opens and closes the storage compartment. The storage compartment may include a refrigerating compartment and a freezing compartment, and the refrigerator door may include a refrigerating compartment door that opens and closes the refrigerating compartment and a freezing compartment door that opens and closes the freezing compartment. The storage compartment may include only a freezing compartment or a refrigerating compartment depending on the type of the refrigerator.

The refrigerator may further include an ice making assembly that produces and stores ice using cold air. The ice making assembly may include an ice maker that produces ice and an ice bin in which ice separated from the ice maker is stored.

When a dispenser for dispensing ice is provided in the refrigerator door, the ice making assembly may further include a motor assembly for crushing ice in the ice bin or driving a blade for discharging ice.

Korean Patent Publication No. 10-1631322, a related art document, discloses a refrigerator.

The refrigerator of the related art includes a support mechanism on which an ice maker is seated, an ice bin seated on the support mechanism, and a motor assembly installed at the support mechanism and selectively connected to the ice bin.

The ice bin includes a plurality of rotary blades for discharging ice and a plurality of stationary blades for crushing ice together with the rotary blades.

A plurality of rotary blades may be rotated in a first direction to discharge each ice (uncrushed ice) from the ice bin. The ice of the ice bin is then discharged from the ice bin without interfering with the plurality of stationary blades.

Meanwhile, in order to discharge the crushed ice from the ice bin, the plurality of rotary blades are rotated in a second direction opposite to the first direction. Then, the ice is crushed by the plurality of rotary blades and the plurality of stationary blades and then discharged from the ice bin.

In the process of dispensing each ice, if the ice is entangled in the ice bin, if the ice lies on the rotary blade, or if the ice is caught on the rotary blade and a wall of the ice bin, the rotary blade may not be rotated normally and the ice may not be dispensed.

However, in the case of the related art document, the motor operates to rotate the plurality of rotary blades in the first direction regardless of whether ice is dispensed. Here, when the rotary blade is not rotated normally, the motor may be damaged due to overload thereof. In addition, even though a user operates an operation pad for discharging ice, ice may not be dispensed and the user may misrecognize that the ice making assembly is broken.

In addition, ice must be crushed so that the crushed ice may be dispensed. Here, a dispersion of torque of the motor for crushing ice is large. If the torque of the motor is large, overload of the motor may occur, but the related art does not provide a technique for preventing the overload of the motor.

In addition, in the case of the related art document, the motor is operated if an ice dispensing command is input, and the motor is stopped if the ice dispensing command is not input.

However, although the operation pad is released due to malfunction of a detection part for detecting the operation pad for an ice dispensing command after the operation pad is operated, if the detection part detects the operation of the operation pad, the motor is not stopped but continuously operates to be damaged.

DISCLOSURE OF THE INVENTION

Technical Problem

An object of the prevent invention is to provide a refrigerator, which performs a process of rearranging ice when restriction conditions occur while the ice is dispensed, and a control method thereof.

Another object of the present invention is to provide a refrigerator, which performs a process of rearranging ice within an ice bin so as to reduce torque applied to a motor after ice pieces are dispensed, and a control method thereof.

Another object of the present invention is to provide a refrigerator, which prevents a motor from continuously operating by malfunction of an operation detection part for detecting an operation pad, and a control method thereof.

Technical Solution

A refrigerator according to one aspect includes: an ice maker configured to generate ice; an ice bin configured to store the ice generated in the ice maker, the ice bin comprising a rotary blade that rotates to discharge the ice; and a motor configured to generate power for allowing the rotary blade to rotate so that ice pieces or ice cubes are dispensed from the ice bin by forward and reverse rotation of the motor, wherein the motor includes a BLDC motor.

The refrigerator includes a counter electromotive force detection part configured to detect counter electromotive force generated while the BLDC motor is driven, an operation pad configured to generate a driving command for the BLDC motor, an operation detection part configured to detect an operation of the operation pad, and a controller configured to receive a signal from the counter electromotive force detection part so as to determine restriction of the BLDC motor, the controller being configured to control the BLDC motor so that the BLDC motor reversely rotates to release the restriction of the BLDC when it is determined that the BLDC motor is restricted.

The controller may be configured to determine whether the operation of the operation pad is not detected when the restriction of the BLDC motor is detected while the BLDC motor operates in the state in which the operation of the operation pad is detected.

The controller may be configured to control the BLDC motor so that the BLDC motor reversely rotates when the operation of the operation pad is not detected.

A method for controlling the refrigerator includes selecting ice pieces through an input part and detecting an operation of an operation pad by an operation detection part to allow a controller to control a BLDC motor so that the BLDC motor rotates in one direction; determining whether restriction of the BLDC motor occurs while the BLDC motor rotates in the one direction; determining whether the operation of the operation pad is not detected by the operation detection part when the restriction of the BLDC motor is not detected while the BLDC motor rotates in the one direction; and stopping the BLDC motor after the controller controls the BLDC motor so that the BLDC motor rotates in the other direction that is opposite to the one direction for a set time when the operation of the operation pad is not detected by the operation detection part.

A refrigerator according to another aspect includes: an ice maker configured to generate ice; an ice bin configured to store the ice generated in the ice maker, the ice bin comprising a rotary blade that rotates to discharge the ice; a motor configured to generate power for allowing the rotary blade to rotate; an operation pad configured to operate so that ice is discharged from the ice bin; an operation detection part configured to detect the operation of the operation pad; and a controller configured to control the motor so that the motor is stopped when the operation of the operation pad is detected by the operation detection part, wherein the controller is configured to control the motor so that the motor rotates in one direction to discharge the ice within the ice bin, and the controller is configured to control the motor so that the motor rotates in the other direction that is opposite to the one direction for a set time when the operation of the operation pad is not detected by the operation detection part while the ice is discharged.

The refrigerator may further include an input part configured to select ice cubes and ice pieces as kinds of ice to be dispensed, wherein the controller may be configured to control the motor so that the motor rotates in the other direction that is opposite to the one direction for the set time when the operation of the operation pad is not detected by the operation detection part while the ice is discharged.

The controller may be configured to stop the motor when the operation of the operation pad is not detected by the operation detection part while the ice cubes are dispensed.

The controller may determine whether reverse rotation conditions of the motor are satisfied while the motor rotates in the one direction to discharge the ice, and when it is determined that the reverse rotation conditions of the motor are satisfied, the controller may be configured to control the motor so that the motor rotates again in the one direction after rotating in the other direction for a reference time when it is determined that the reverse rotation conditions of the motor are satisfied.

The motor may include a BLDC motor, and when the number of pulses output from the motor per unit time is N in a state in which a load is not applied to the motor, if the reverse rotation conditions of the motor are satisfied, the number of pulses output from the motor per unit time may be N or more than an upper limit that is less than N.

The motor may include a BLDC motor, and when the number of pulses output from the motor per unit time is N in a state in which a load is not applied to the motor, if the reverse rotation conditions of the motor are satisfied, the number of pulses output from the motor per unit time may be less than a lower limit that is less than N.

When a time at which the operation of the operation pad is detected by the operation detection part reaches a time limit while the motor operates, the controller may be configured to stop the motor.

Advantageous Effects

According to the proposed invention, when the restriction condition occurs while the ice is dispensed, the rearrangement of the ice may be performed to prevent the motor from being damaged and to allow the ice from being smoothly discharged.

Also, according to the present invention, the rearrangement of the ice in the ice bin may be performed after the ice cubes are completely dispensed, and thus, there is the advantage that the torque applied to the motor is reduced when the next ice cube is dispensed.

Also, according to the present invention, the continuous operation of the motor due to the malfunction of the operation detection part may be prevented.

MODE FOR CARRYING OUT THE INVENTION

Figure 1:
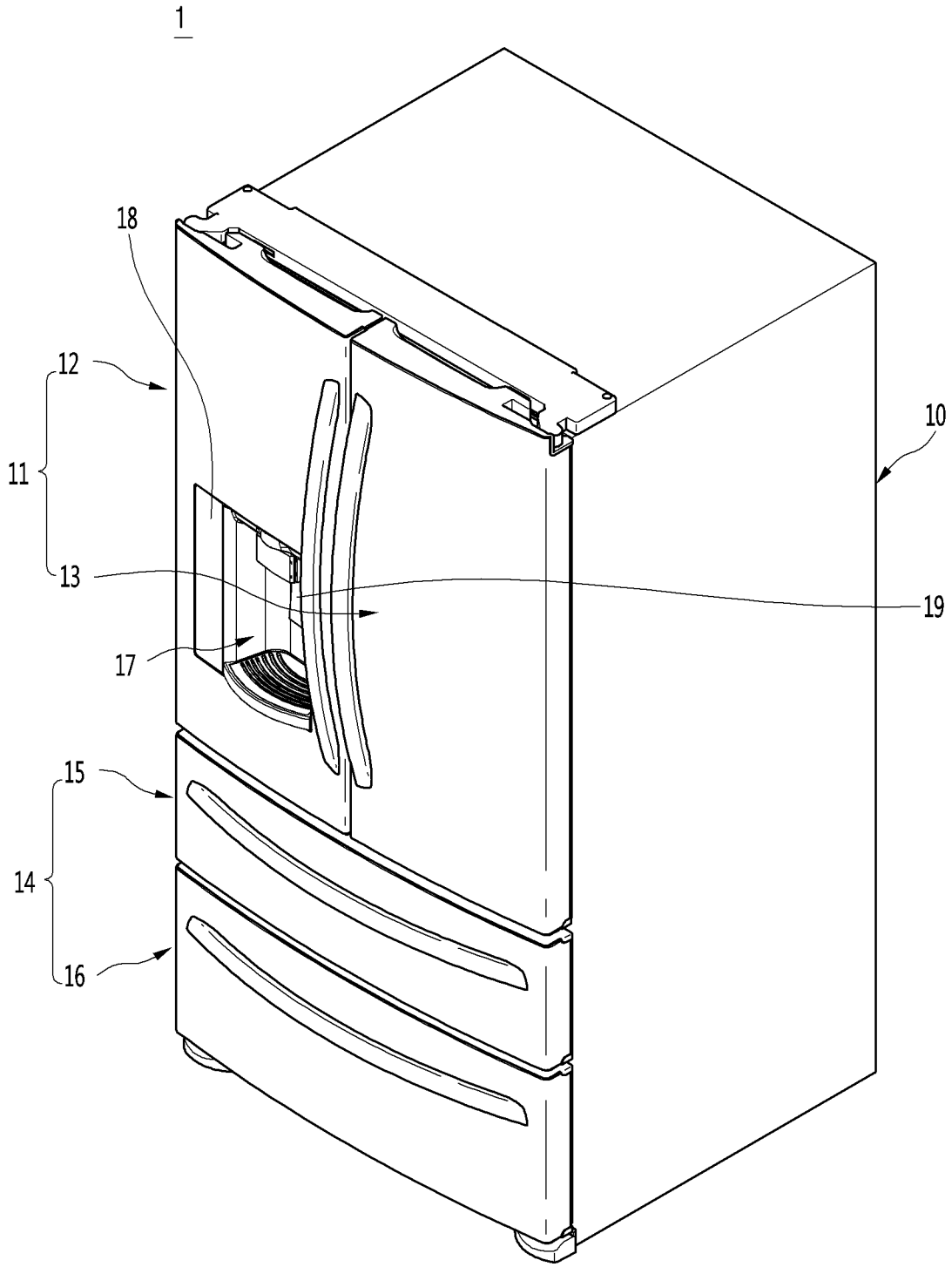
FIG. 1 is a perspective view of a refrigerator in an embodiment of the present invention.

Hereinafter, embodiments of the present invention will be described in detail with reference to the accompanying drawings. In adding reference numerals for elements in each figure, it should be noted that like reference numerals already used to denote like elements in other figures are used for elements wherever possible. Moreover, detailed descriptions related to well-known functions or configurations will be ruled out in order not to unnecessarily obscure subject matters of the present invention.

In describing the elements of the present invention, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present.

Figure 2:
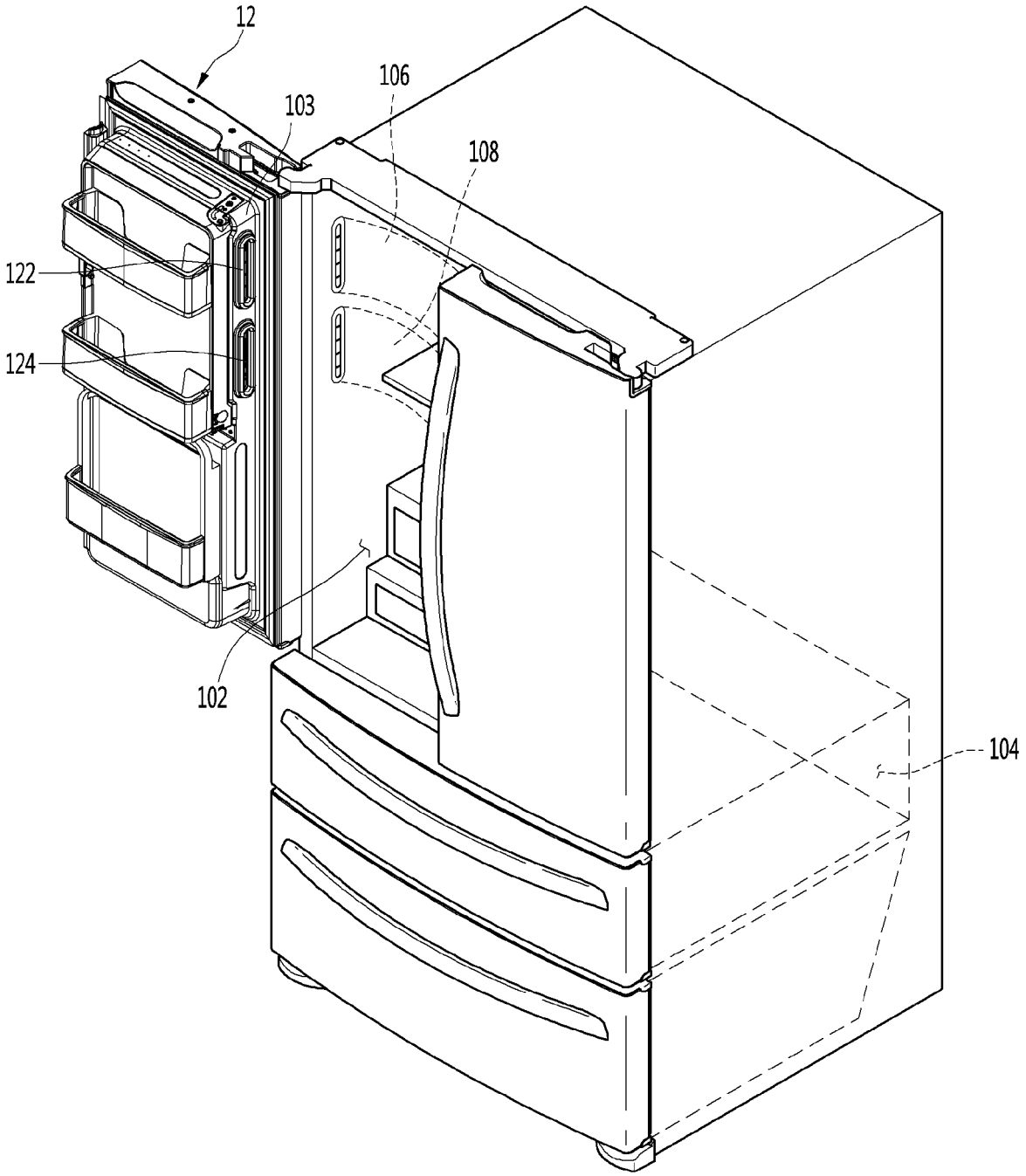
FIG. 2 is a perspective view illustrating a state where a door is partially opened according to an embodiment of the present invention.

FIG. 1 is a perspective view of a refrigerator according to an embodiment of the present invention and FIG. 2 is a perspective view illustrating a state where a door is partially opened according to an embodiment of the present invention.

Referring to FIGS. 1 and 2, a refrigerator 1 according to an embodiment of the present invention includes a cabinet 10 forming an appearance and refrigerator doors movably connected to the cabinet 10.

A storage compartment for storing food may be formed in the cabinet 10. The storage compartment may include a refrigerating compartment 102 and a freezing compartment 104 positioned below the refrigerating compartment 102.

In the present embodiment, as an example, a bottom freeze type refrigerator in which a refrigerating compartment is disposed above a freezing compartment will be described. However, the idea of the present embodiment may also be applied to a refrigerator in which a refrigerating compartment is disposed below a freezing compartment, a refrigerator including only a freezing compartment, or a refrigerator in which a freezing compartment and a refrigerating compartment are arranged left and right.

The refrigerator doors may include a refrigerating compartment door 11 for opening and closing the refrigerating compartment 102 and a freezing compartment door 14 for opening and closing the freezing compartment 104.

The refrigerating compartment door 11 may include a plurality of doors 12 and 13 disposed left and right. The plurality of doors 12 and 13 may include a first refrigerating compartment door 12 and a second refrigerating compartment door 13 disposed on the right of the first refrigerating compartment door 12. The first refrigerating compartment door 12 and the second refrigerating compartment door 13 may move independently.

The freezing compartment door 14 may include a plurality of doors 15 and 16 disposed up and down.

The plurality of doors 15 and 16 may include a first freezing compartment door 15 and a second freezing compartment door 16 positioned below the first freezing compartment door 15.

The first and second refrigerating compartment doors 12 and 13 may rotate or the first and second freezing compartment doors 15 and 16 may slidably move.

As another example, the first freezing compartment door 15 and the second freezing compartment door 16 may be disposed on the left and right to rotate each other.

Meanwhile, one of the first and second refrigerating compartment doors may be provided with a dispenser 17 for dispensing water and/or ice. In FIG. 1, for example, the dispenser 17 is provided at the first refrigerating compartment door 12. Alternatively, the dispenser 17 may be provided at the freezing compartment doors 15 and 16.

In addition, one of the first and second refrigerating compartment doors may be provided with an ice making assembly (to be described later) for producing and storing ice. Alternatively, the ice making assembly may be provided at the freezing compartment 104.

In the present embodiment, the dispenser 17 and the ice making assembly may be provided at the first refrigerating compartment door 12 or the second refrigerating compartment door 13. Therefore, hereinafter, the dispenser 17 and the ice making assembly will be described as being disposed at the refrigerating compartment door 11 commonly called the first refrigerating compartment door 12 and the second refrigerating compartment door 13.

The refrigerating compartment door 11 may be provided with an input part 18 for selecting a type of ice to be dispensed. In addition, the dispenser 17 may include an operation pad 19 operated by a user to dispense water or ice. Alternatively, a button or a touch panel may be provided to input a water or ice dispensing command.

Figure 3:
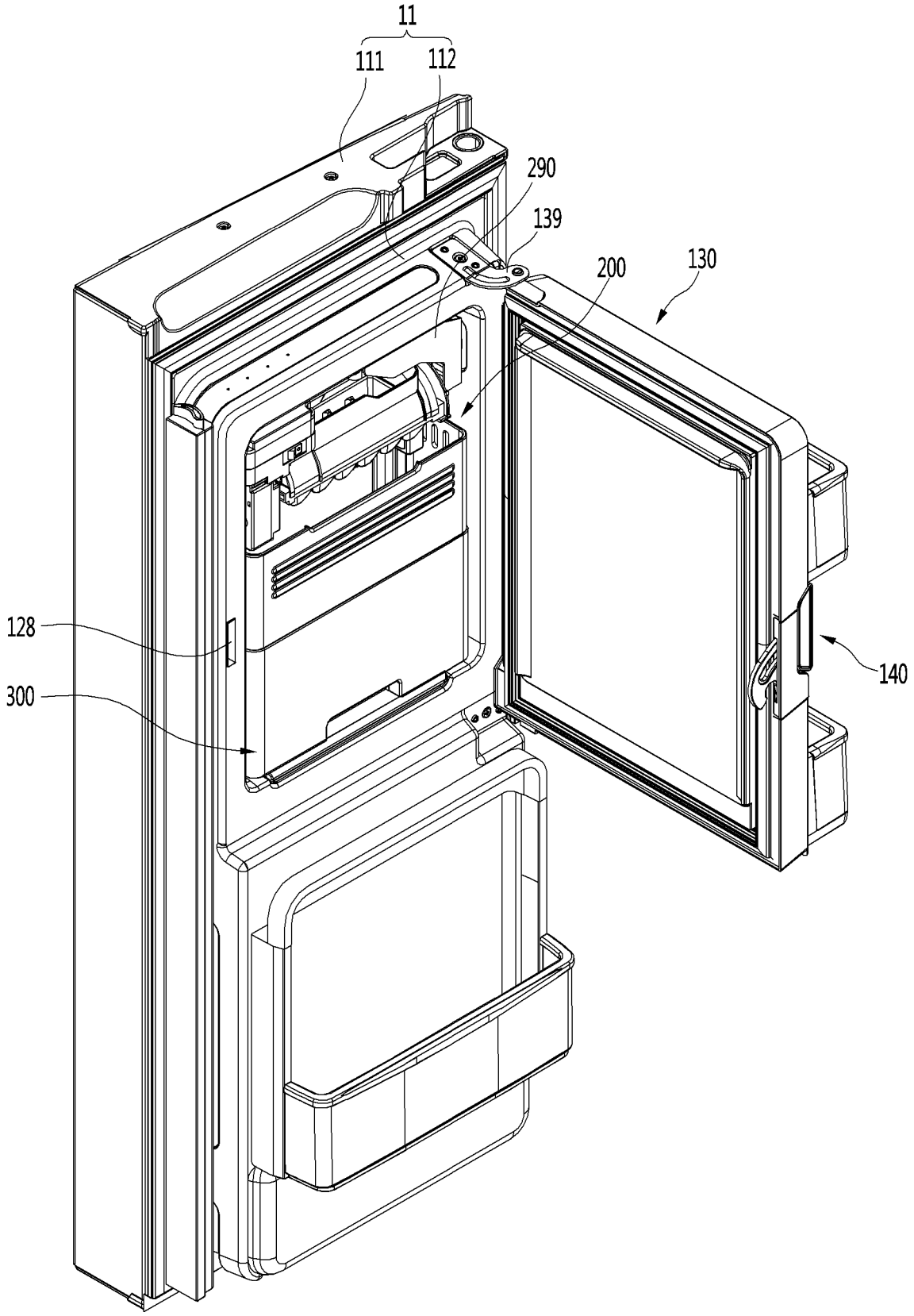
FIG. 3 is a perspective view of a refrigerating compartment door in a state where an ice making compartment door is opened according to an embodiment of the present invention.
Figure 4:
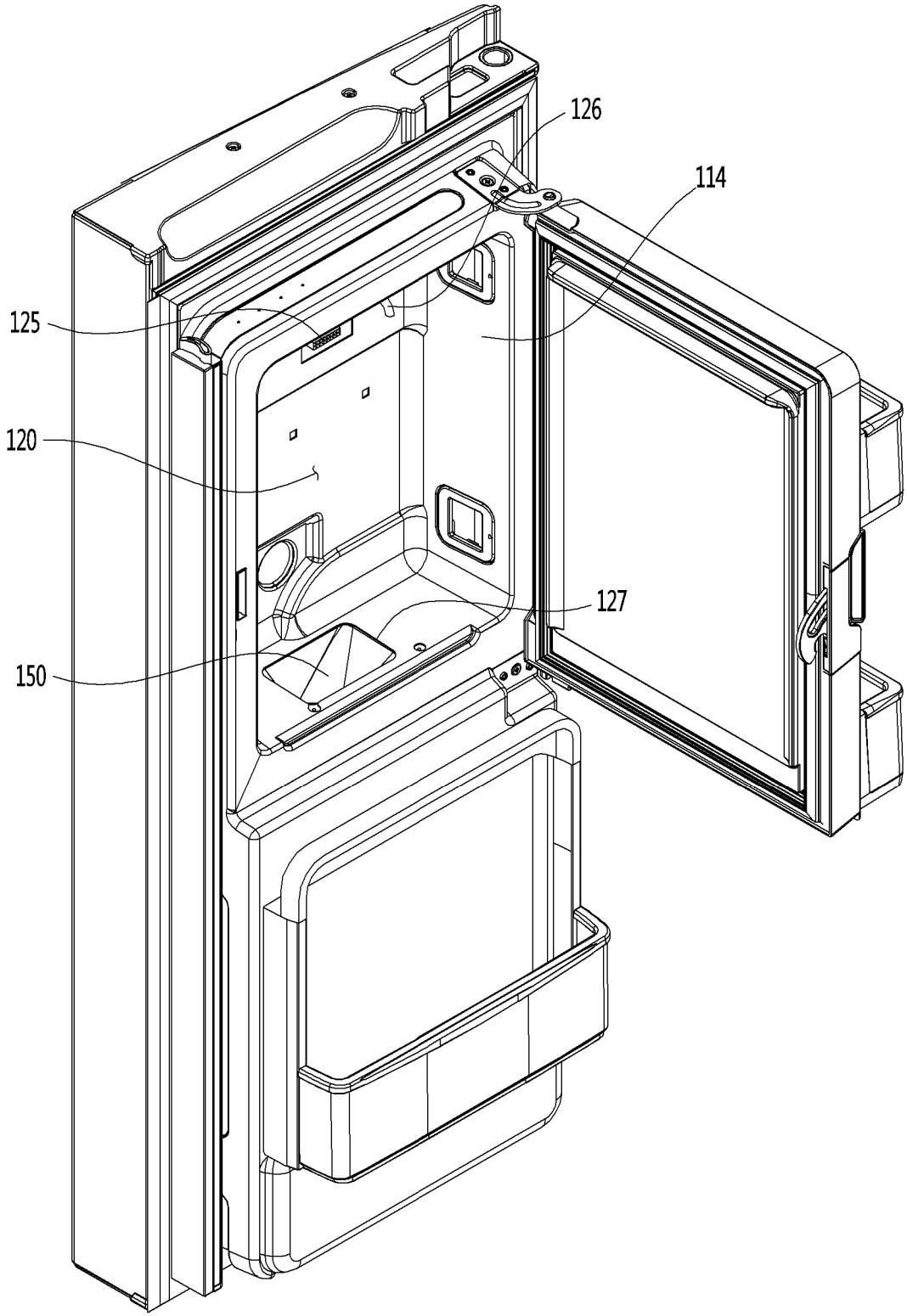
FIG. 4 is a perspective view of a refrigerating compartment door in a state where an ice making assembly is removed from an ice making compartment according to an embodiment of the present invention.

FIG. 3 is a perspective view of a refrigerating compartment door in a state where an ice making compartment door is open according to an embodiment of the present invention and FIG. 4 is a refrigerating compartment door in a state where an ice making assembly is removed from an ice making compartment according to an embodiment of the present invention.

Referring to FIGS. 1 to 4, the refrigerating compartment door 11 may include an outer case 111 and a door liner 112 coupled to the outer case 111. The door liner 112 may form a rear surface of the refrigerating compartment door 11.

The door liner 112 may form an ice making compartment 120. An ice making assembly 200 for producing and storing ice is disposed in the ice making compartment 120. The ice making compartment 120 may be opened or closed by an ice making compartment door 130. The ice making compartment door 130 may be rotatably connected to the door liner 112 by a hinge 139.

In addition, the ice making compartment door 130 may have a handle 140 allowing the ice making compartment door 130 to be coupled to the door liner 112 while the ice making compartment door 130 closes the ice making compartment 120.

A handle coupling portion 128 to which a portion of the handle 140 is coupled may be formed at the door liner 112. The handle coupling portion 128 may accommodation a portion of the handle 140.

The cabinet 10 includes a main body supply duct 106 for supplying cold air to the ice making compartment 120 and a main body recovery duct 108 for recovering cold air from the ice making compartment 120. The main body supply duct 106 and the main body recovery duct 108 may be in communication with a space where an evaporator (not shown) is located.

The refrigerating compartment door 11 includes a door supply duct 122 for supplying cold air from the main body supply duct 106 to the ice making compartment and a door recovery duct 124 recovering cold air from the ice making compartment 120 to the main body recovery duct 108.

The door supply duct 122 and the door recovery duct 124 extend from an outer wall 113 of the door liner 110 to an inner wall 114 forming the ice making compartment 120.

The door supply duct 122 and the door recovery duct 124 are disposed in a vertical direction and the door supply duct 122 is disposed above the door recovery duct 124. However, in the present embodiment, the positions of the door supply duct 122 and the door recovery duct 124 are not limited thereto.

In addition, in a state where the refrigerating compartment door 11 closes the refrigerating compartment 102, the door supply duct 122 is aligned with and communicates with the main body supply duct 106 and the door recovery duct 124 is aligned with and communicates with the main body recovery duct 108.

The ice making compartment 200 includes a cold air duct 290 for guiding the cold air flowing through the door supply duct 122 to the ice making assembly 200.

The cold air duct 290 has a flow path through which cold air flows, and the cold air flowing through the cold air duct 290 is finally supplied to the ice making assembly 200 side. The cold air may be concentrated on the ice making assembly 200 side by the cold air duct 290, ice may be rapidly produced.

An opening 127 through which ice is discharged is formed on a lower side of the inner wall 114 of the door liner 112 forming the ice making compartment 120. In addition, an ice duct 150 communicating with the opening 127 may be disposed on a lower side of the ice making compartment 120.

Figure 5:
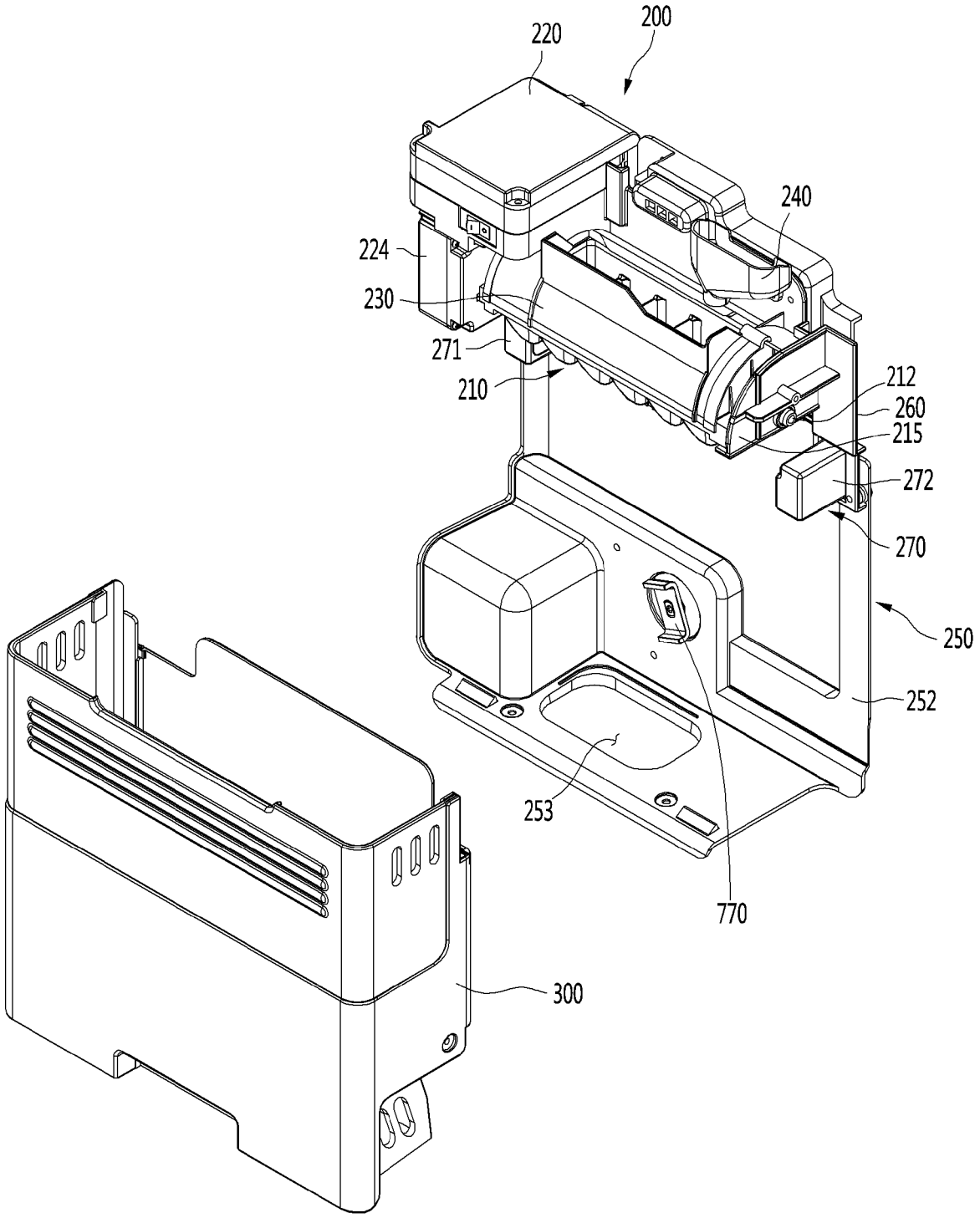
FIG. 5 is a view showing a state where an ice bin is separated from a support mechanism according to an embodiment of the present invention.
Figure 6:
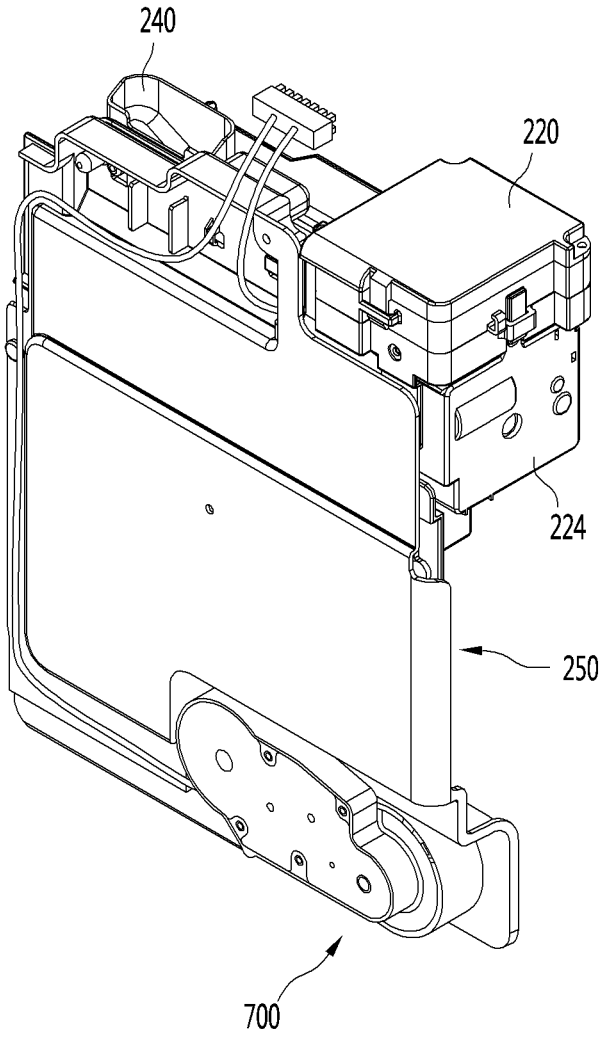
FIG. 6 is a view showing a state where a motor assembly is coupled to the rear of a support mechanism.

FIG. 5 is a view illustrating a state where an ice bin is separated from a support mechanism according to an embodiment of the present invention and FIG. 6 is a view illustrating a state where a motor assembly is coupled to a rear side of the support mechanism.

Referring to FIGS. 5 and 6, the ice making assembly 200 according to an embodiment of the present invention may define a space where ice is produced and include an ice maker 210 supporting produced ice.

The ice making assembly 200 may further include a driving source 220 that provides power for automatically rotating the ice maker 210 to separate the ice from the ice maker 210 and a power transmission box 224 for transmitting power of the ice maker 210.

The ice making assembly 200 may further include a cover 230 that covers the ice maker 210 to prevent overflow of water when water is supplied to the ice maker 210 and a water guiding portion 240 guiding water supplied from a water supply pipe 126 to the ice maker 210.

The ice making assembly 200 may include a support mechanism 250 having a seating portion 215 on which the ice maker 210 is seated, an ice bin configured to store ice separated from the ice maker 210, and a motor assembly 700 connected to the ice bin 300.

The support mechanism 250 may include a first support portion 252 and a second support portion 260 coupled to the first support portion 252. Alternatively, the first support portion 252 and the second support portion 260 may be integrally formed.

The first support portion 252 may be seated in the ice making compartment 120. The motor assembly 700 is mounted on the first support portion 252. In this case, the motor assembly 700 may be coupled to a rear side of the support mechanism 250.

Meanwhile, the ice bin 300 may be seated on a bottom surface of the first support portion 252 on the front of the support mechanism 250. That is, the first support portion 252 may support the ice bin 300.

In order to transmit power of the motor assembly 700 to the ice bin 300, a connection member 770 may be connected to the motor assembly 700 on the front of the support mechanism 250. Then, the connection member 770 may be connected to the ice bin 300 while the ice bin 300 is supported on the front of the support mechanism 250.

An ice opening 253 through which ice discharged from the ice bin 300 passes may be formed on a bottom surface of the first support portion 252.

When the ice bin 300 is seated on the first support portion 252, the motor assembly 700 is connected to the ice bin 300 by the connection member 770. In this embodiment, a state where the ice bin 300 is seated on the first support portion 252 may refer to a state where the ice bin 300 is accommodated in the ice making compartment 120.

A seating portion 215 on which the ice maker 210 is seated may be formed at the second support portion 260.

A rotary shaft 212 is provided on one side of the ice maker 210 and rotatably connected to the mounting portion 215. An extending portion (not shown) extending from the power transmission box 224 may be connected to the other side of the ice maker 210.

An ice fullness detector 270 may be installed at the second support portion 260 at a position spaced apart from the ice maker 210. In addition, the ice fullness sensor 270 is located below the ice maker 210.

The ice fullness detector 270 includes a transmitter 271 transmitting a signal and a receiver 272 spaced apart from the transmitter 271 and receiving the signal from the transmitter 271. The transmitter 271 and the receiver 272 are positioned in an internal space of the ice bin 300 in a state where the ice bin 300 is seated on the first support portion 252.

Figure 7:
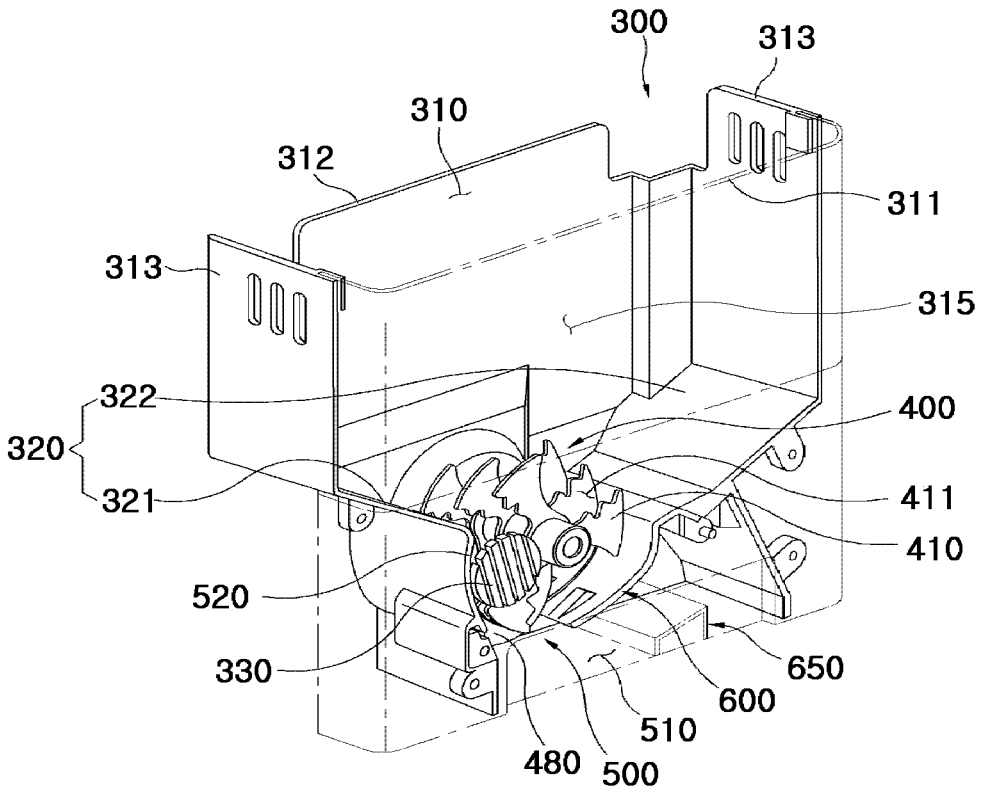
FIG. 7 is a perspective view of an ice bin according to an embodiment of the present invention.

FIG. 7 is a perspective view of an ice bin according to an embodiment of the present invention.

Referring to FIG. 7, the ice bin 300 has an opening 310 formed at an upper portion thereof. The ice bin 300 includes a front wall 311, a rear wall 312, and opposing side walls 313.

The inside of the ice bin 300 is provided with an inclined guide surface 320 for supporting stored ice and guiding the stored ice to slide downward by a self-load.

An ice storage space 315 in which ice is stored is formed by the front wall 311, the rear wall 312, the opposing side walls 313, and the inclined guide surface 320.

The inclined guide surface 320 may include a first inclined guide surface 321 and a second inclined guide surface 322. The first inclined guide surface 321 may be inclined downward toward a central portion from one of the opposing side walls 313, and the second inclined guide surface 322 may be inclined downward toward the central portion from the other of the opposing side walls 313.

A movable part 400 for discharging ice accommodated in the ice bin 300 to the outside of the ice bin 300 may be provided between the first inclined guide surface 321 and the second inclined guide surface 322.

The movable part 400 may include a plurality of rotary blades 410 to facilitate discharge of ice. The plurality of rotary blades 410 are spaced apart from each other, and a space 411 is formed between two adjacent rotary blades 410.

Ice placed on the first inclined guide surface 321 and the second inclined guide surface 322 is moved to the movable part 400 side by a self-load and then discharged to the outside by the operation of the movable part 400.

A discharge part 500 having an outlet 510 through which ice is discharged may be provided between the first inclined guide surface 321 and the second inclined guide surface 322. In addition, the movable part 400 may be rotatably provided in the discharge part 500.

The movable part 400 may be rotated in both directions by the motor assembly 700.

For example, in order to discharge each ice (uncrushed ice) from the discharge part 500, the movable part 400 may be rotated in the first direction.

Meanwhile, in order to discharge crushed ice from the discharge part 500, the movable part 400 may be rotated in a second direction opposite to the first direction.

A plurality of stationary blades 480 for crushing ice together with the rotary blade 410 of the movable part 400 may be provided on one side below the movable part 400, i.e., on one side of the discharge part 500, when the movable part 400 rotates in the first direction.

The plurality of stationary blades 480 are spaced apart from each other, and the rotary blade 410 passes through a space between the plurality of stationary blades 480.

In a state where the ice is caught between the stationary blade 480 and the rotary blade 410, when the rotary blade 410 presses ice, while being rotated, the ice is crushed and pieces of ice may be discharged from the discharge part 500.

Meanwhile, an opening member 600 allowing the outlet 510 and the ice storage space 315 to selectively communicate with each other so that each ice is discharged when the movable part 400 rotates in the second direction may be provided on the other side below the movable part 400, i.e., on the other side of the discharge part 500.

An operation limiting portion 650 preventing ice in each ice state from being excessively discharged by limiting an operation range of the opening and closing member 600 is provided below the opening and closing member 600.

The discharge part 500 is provided with a discharge guide wall 520 formed in a shape corresponding to a rotation trace of the rotary blade 410. The stationary blade 480 is mounted below the discharge guide wall 520.

The discharge guide wall 500 prevents the crushed ice pieces from remaining at the discharge part 500. In order to prevent ice from being caught between the rotary blade 410 and the front wall 311 of the ice bin 300, an ice insertion preventing portion 330 protruding toward the rotary blade 410 may be provided on a rear surface of the front wall 311 of the ice bin 300.

Figure 8:
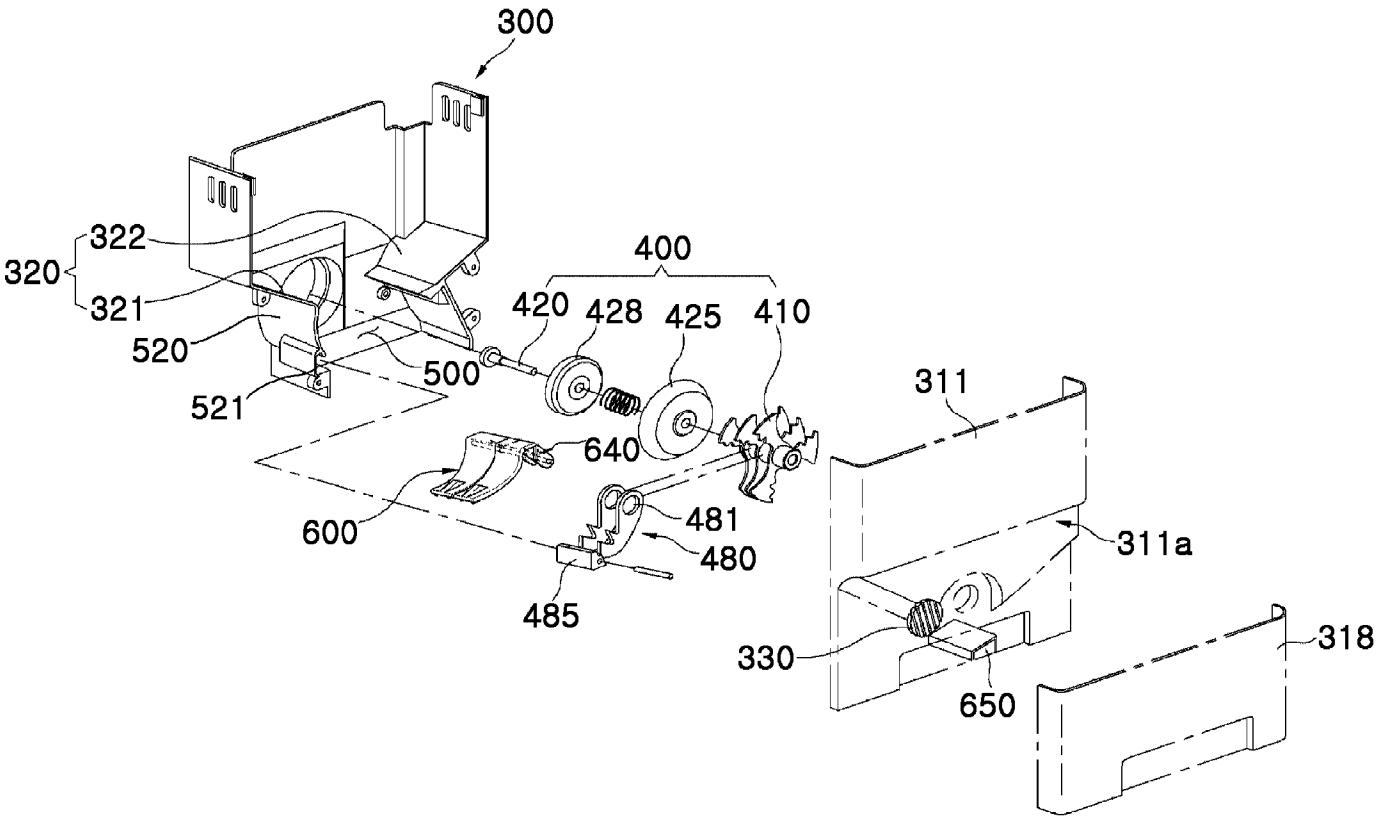
FIG. 8 is an exploded perspective view of an ice bin according to an embodiment of the present invention.

FIG. 8 is an exploded perspective view of an ice bin according to an embodiment of the present invention.

Referring to FIGS. 7 and 8, the plurality of rotary blades 410 are installed on a rotary shaft 420. The rotary shaft 420 passes through a support plate 425 and a connection plate 428 connected to the motor assembly 700. The rotary shaft 420 is disposed in a horizontal direction inside the ice bin 300.

The plurality of rotary blades 410 are arranged to be spaced apart from each other in a direction parallel to an extending direction of the rotary shaft 420.

One side of the plurality of stationary blades 480 is connected to the rotary shaft 420. That is, the rotary shaft 420 passes through the plurality of stationary blades 480. Each of the stationary blades has a through hole 481 through which the rotary shaft 420 passes.

Here, a size of the through hole 481 may be larger than a diameter of the rotary shaft 420 so that the stationary blade 480 may not move while the rotary shaft 420 rotates.

The plurality of rotary blades 410 and the plurality of stationary blades 480 are alternately arranged in a direction parallel to the extending direction of the rotary shaft 420.

The other side of the plurality of stationary blades 480 is fixed to a lower side of the discharge guide wall 520 as described above. A fixed member 485 may be connected to the other side of the plurality of stationary blades 480 and may be inserted into a recess 521 formed on the discharge guide wall 520.

Meanwhile, the opening and closing member 600 may be provided as member or as a plurality of members and may be disposed on the side of the plurality of stationary blades 480.

The opening and closing member 600 may be rotatably provided at the discharge part 500 and may be formed of an elastic material or may be supported by an elastic member 540 such as a spring.

This is to allow an end portion thereof to move downward due to a pressing action of ice and to return to its original position when the pressing action of the ice is released.

After the movable part 400, the stationary blade 480, the opening and closing member 600 are mounted at the ice bin 300, a front plate 311*a* forming the front wall 311 of the ice bin 300 311*a* may be mounted.

A cover member 318 may be provided on a lower portion of a front surface of the front plate 311*a* to prevent the opening and closing member 600 or the stationary blade 480 from being exposed to the outside.

Figure 9:
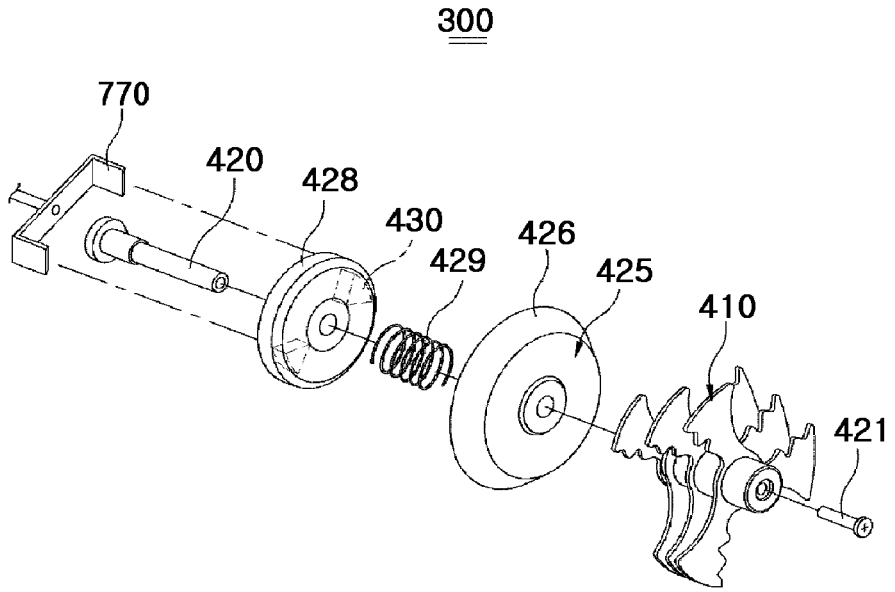
FIG. 9 is an exploded perspective view of a movable part of an ice bin according to an embodiment of the present invention.

FIG. 9 is an exploded perspective view of a movable part of an ice bin according to an embodiment of the present invention.

Referring to FIGS. 7 to 9, a coil spring type elastic member 429 may be disposed between the support plate 425 and the connection plate 428 to elastically support the connection plate 428.

An insertion member may be inserted into a front end portion of the rotary shaft 420 in a state where the rotary blade 410, the support plate 425, the connection plate 428, and the elastic member 429 are coupled to the rotary shaft 420.

A connection member 770 selectively connected to the connection plate 428 is connected to the motor assembly 700. The connection plate 428 is provided with a protrusion 430 allowing the connection member 770 to be caught therein.

In a state where a user accommodates the ice bin 300 in the ice making compartment 120, when the protrusion 430 and opposing ends of the connection member 770 are aligned, the connection member 770 is not caught at the protrusion 430. In this case, the guide plate 428 moves in a direction toward the support plate 425 by the elastic member 429.

Thereafter, when alignment of the opposing ends of the connection member 770 and the protrusion 430 is released by a continuous operation of the motor assembly 700, the connection plate 428 is moved backward by the elastic member 429 and the opposing ends of the connection member 770 are caught by the protrusion 430.

Meanwhile, the support plate 425 may be formed with an inclined surface 426 to smoothly move ice located on a side surface of the support plate 425 toward the plurality of rotary blades 410.

Figure 10:
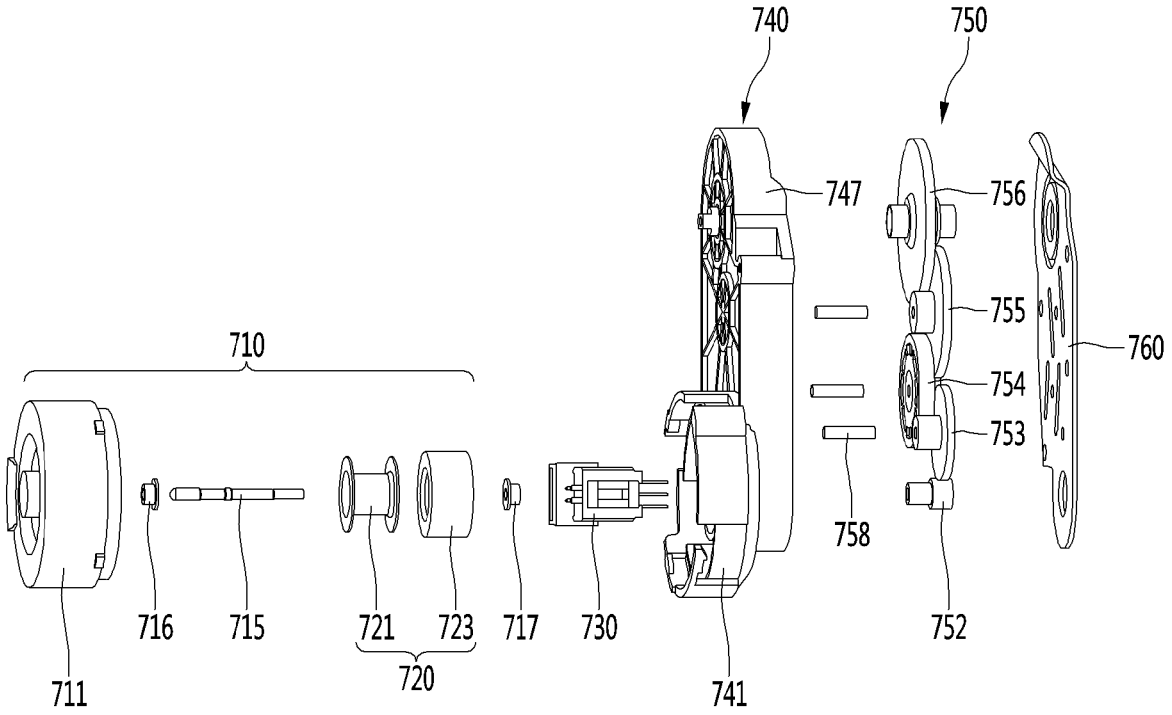
FIG. 10 is an exploded perspective view of a motor assembly according to an embodiment of the present invention.
Figure 11:
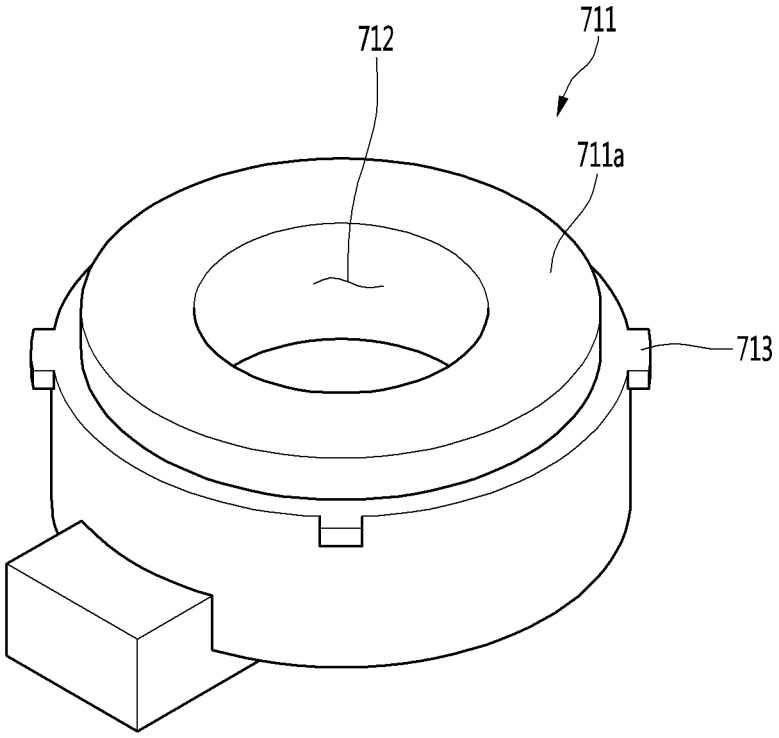
FIG. 11 is a perspective view of a stator of a motor according to an embodiment of the present invention.
Figure 12:
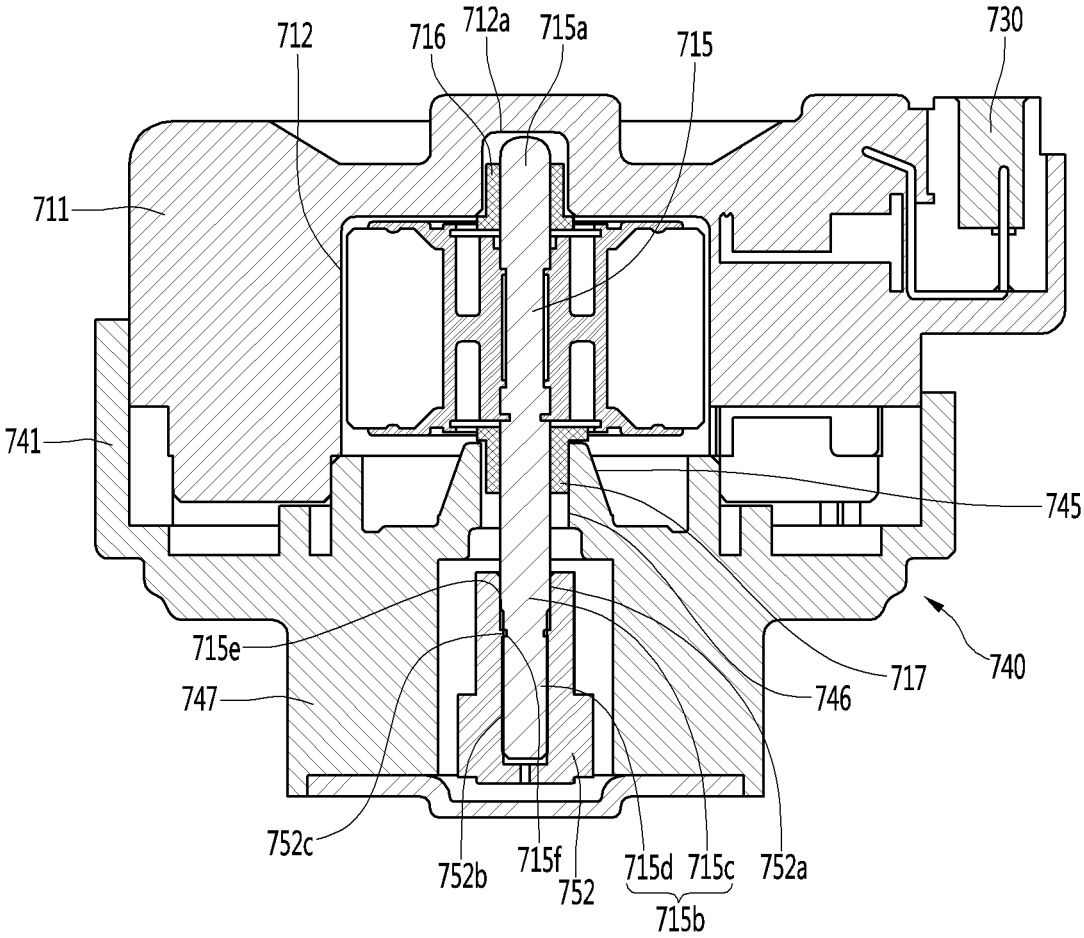
FIG. 12 is a cross-sectional view showing a state where a motor is installed in a gear box of the present invention.
Figure 13:
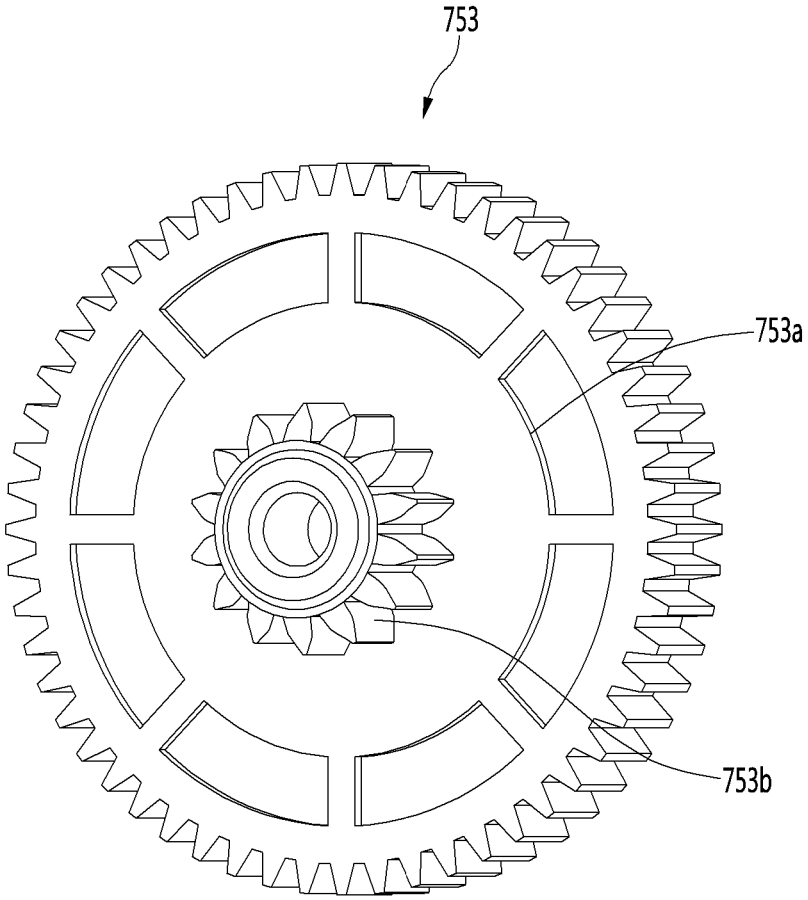
FIG. 13 is a perspective view of some gears of a power transmission part according to an embodiment of the present invention.

FIG. 10 is an exploded perspective view of a motor assembly according to an embodiment of the present invention and FIG. 11 is a perspective view of a stator of a motor according to an embodiment of the present invention. FIG. 12 is a cross-sectional view showing a state where a motor is installed in a gear box of the present invention. FIG. 13 is a perspective view of some gears of a power transmission part according to an embodiment of the present invention.

Referring to FIGS. 10 to 13, the motor assembly 700 according to an embodiment of the present invention includes a motor 710, a gear box 740 in which the motor 710 is installed, and a power transmission part 750 installed in the gear box 740.

The motor 710 may be a BLDC motor. The counter electromotive force is generated due to the characteristics of the BLDC motor. A controller (that will be described below) connected to the motor 710 may detect the counter electromotive force of the motor 710 to determine whether the motor 710 is restricted.

For example, the controller may detect a load applied to the motor 710 and whether the motor 710 is restricted based on the number of pulses output from the motor 710.

By detecting the load applied to the motor 710, the controller may control a rotation direction or a rotation speed of the motor 710.

The motor 710 may include a stator 711 and a rotor 720 rotated with respect to the stator 711.

The stator 711 may include a housing 711*a* and a coil (not shown) provided in the housing 711*a*. The coil may be wound around a stator core (not shown), and the housing 711*a* may be integrally formed with the stator core by insert injection molding in a state where the coil is wound around the stator core.

A space 712 allowing the rotor 720 to be positioned therein is formed at a central portion of the housing 711*a*.

A connector 730 for supplying current may be connected to the coil located in the housing 711*a*. The connector 730 may be installed at the housing 411*a*.

For example, in a state where the connector 730 is connected to the coil, the housing 711*a* may be integrally formed with the connector 730 by insert injection molding. Therefore, since a connection portion of the connector 730 and the coil is located in the housing 711*a*, insulating performance is improved. The connector 730 may be connected to the controller.

The rotor 720 may be accommodated in the space 712 in the housing 711*a*. In this case, the rotor 720 may exist as a component independent of the stator 711.

That is, the rotor 720 is not located in the housing 711*a* of the stator 711 and is accommodated in the space 712 formed in the housing 711*a* outside the housing 711*a* of the stator 711. In this case, the stator 711 and the rotor 720 may be separated from each other without disassembling the motor 710.

The rotor 720 may include a magnet 723 and a magnet supporter 721 supporting the magnet 723. For example, the magnet 723 may be arranged in a circumferential direction of the magnet supporter 721.

The motor 710 may further include a shaft 715 connected to the rotor 720.

The shaft 715 may be connected to the magnet supporter 721 and rotated together with the magnet supporter 721. For example, the shaft 715 may be press-fit into the magnet supporter 721. The shaft 715 may pass through the magnet supporter 721.

In a state where the shaft 715 is connected to the magnet supporter 721, a first portion 715*a* of the shaft 415 may pass through the magnet supporter 721 and then protrude from the magnet supporter 721 in a first direction (upward with reference to FIG. 12).

A first bearing 716 may be coupled to the first portion 415*a* of the shaft 715 protruding from the magnet supporter 721. For example, the first portion 715*a* of the shaft 715 may be coupled to penetrate through the first bearing 716.

For example, the first bearing 716 may be formed of a polyphenylene sulfide (PPS) material.

The housing 711*a* may be provided with a recess 712*a* for accommodating the first portion 715*a* of the shaft 715. The recess 712*a* may be depressed in the first direction in the space 712.

The first bearing 716 may be coupled to the recess 712*a*. Accordingly, the first bearing 716 may prevent the shaft 715 from coming into direct contact with the housing 711*a*.

In a state where the shaft 715 is connected to the magnet supporter 721, a second portion 715*b* of the shaft 715 may pass through the magnet supporter 721 and then protrude from the magnet supporter in a second direction (downward with reference to FIG. 12).

In this case, a length of the second portion 715*b* of the shaft 715 may be longer than that of the first portion 715*a*.

In addition, a second bearing 717 may be coupled to the second portion 715*b* of the shaft 715. For example, the second portion 715*b* of the shaft 715 may be coupled to penetrate through the second bearing 717.

For example, the second bearing 716 may be formed of a polyphenylene sulfide (PPS) material.

The second portion 715*b* of the shaft 715 may be connected to a shaft connection portion 752 (or a shaft connection gear) to be described later.

The second portion 715*b* of the shaft 715 may be press-fit into the shaft connection portion 752.

Specifically, the second portion 715*b* of the shaft 715 may include a first cylindrical portion 715*c* and a second cylindrical portion 715*d* extending from the first cylindrical portion 715*c*.

The second cylindrical portion 715*d* may have a diameter smaller than the first cylindrical portion 715*c*. The second cylindrical portion 715*d* and the first cylindrical portion 715*c* may be connected by an inclined connection portion 715*e*. In addition, the second cylindrical portion 715*d* may be press-fit into the shaft connection portion 752.

The shaft connection portion 752 may include an accommodation recess in which the second portion 715*b* of the shaft 715 is accommodated. The accommodation recess may include a first accommodation recess 752*a* in which the first cylindrical portion 715*c* is accommodated and a second accommodation recess 752*b* in which the second cylindrical portion 715*d* is accommodated.

The second cylindrical portion 715*d* may be accommodated in the second accommodation recess 752*b* after passing through the first accommodation recess 752*a*. In this case, the first cylindrical portion 715*c* may be smoothly accommodated in the first accommodation recess 752*a* by the inclined connection portion 715*e*.

An outer circumferential surface of the second cylindrical portion 715*d* may be knurled, for example, and the second cylindrical portion 715*d* may be press-fit into the second accommodation recess 752*b*. To this end, a diameter of the second cylindrical portion 715*d* may be larger than a diameter of the second accommodation recess 752*b*. Meanwhile, a diameter of the first cylindrical portion 715*c* may be equal to or smaller than a diameter of the first accommodation recess 752*a*.

An insertion recess 715*f* is formed around the second cylindrical portion 715*d*, and an insertion protrusion 752*c* is formed on the first accommodation recess 752*a* or the second accommodation recess 752*b*.

Therefore, according to the present embodiment, as the shaft 715 is press-fit into the shaft connection portion 752 and the insertion protrusion 752*c* is inserted into the insertion recess 715*f*, the shaft 715 may be prevented from being released from the shaft connection portion 752 or the shaft 715 is prevented from being idly rotated with respect to the shaft connection portion 752 in a state where the shaft is press-fit into the shaft connection portion 752.

In addition, since the diameter of the first cylindrical portion 715*c* is larger than the diameter of the second cylindrical portion 715*d*, although fine powder is produced while the second cylindrical portion 715*d* is press-fit into the second accommodation recess 752*b*, the first cylindrical portion 715*c* may block outflow of the fine powder.

The gear box 740 may include a first installation portion 741 to which the motor 710 is coupled and a second installation portion 747 on which the power transmission part 750 for transmitting power from the motor 710 is installed.

The first installation portion 741 and the second installation portion 747 may be integrally formed. The stator 711 of the motor 710 may be detachably coupled to the first installation portion 741.

In the present embodiment, the stator 711 may be installed in the first installation portion 741 in a state where the shaft 715 of the rotor 720 is connected to the shaft connection portion 752.

Therefore, a fastening force is not transmitted between the shaft connection portion 752 and the other gears (to be described later) while the stator 711 is installed in the first installation portion 741, thus preventing a slip phenomenon between the gears.

A coupling structure of the stator 711 and the first installation portion 741 will be described later with reference to the drawings.

The first installation portion 741 may be provided with a bearing support portion 745 for supporting the second bearing 717.

The second bearing 717 may be inserted into the bearing support portion 745. An opening 746 is provided at the bearing support portion 745, and the second portion 715*b* of the shaft 715 may pass through the opening 746 of the bearing support portion 745.

The second portion 715*b* of the shaft 715 penetrating through the opening 746 of the bearing support portion 745 may protrude to a space formed by the second installation portion 747.

The shaft connection portion 752 may be coupled to the second portion 715*b* of the shaft 715 in the space of the second installation portion 747.

The power transmission part 750 may include the shaft connection portion 752 and one or more gears 753, 754, 755, and 756 for transmitting power from the shaft connection portion 752 to the connection member 770.

FIG. 10 illustrates a plurality of gears 753, 754, 755, and 756 as an example. In the case of using the plurality of gears 753, 754, 755, and 756, it is possible to reduce a rotational speed of the motor 710 and to transmit torque of a required size to the connection member 770.

The plurality of gears may include a first gear 753, a second gear 754, a third gear 755, and a fourth gear 756.

Gear teeth may be formed around the shaft connection portion 752 and engage with the first gear 753 among the plurality of gears 753, 754, 755, and 756. Here, since the gear teeth are formed at the shaft connection portion 752, the shaft connection portion 752 may be described as a gear.

The plurality of gears 753, 754, 755, and 756 may be rotatably supported on the second installation portion 747 by a gear pin 758. In addition, the connection member 470 may be connected to a fourth gear 756, which is the last gear among the plurality of gears 753, 754, 755, and 756.

Here, in a state where the connection member 770 is located on one side of the first installation portion 747 and the fourth gear 756 is located on the other side of the connection member 770 with respect to the first installation portion 757, the connection member 770 may be fastened with the fourth gear 756 by a fastening member such as a screw.

In the present embodiment, a shaft connection portion 752 of the power transmission portion 750 connected to the motor 710 has a small torque, and the torque increases as it passes by the plurality of gears.

Therefore, in the present embodiment, the shaft connection portion 752 and the first gear 753 connected to the shaft 715 of the motor 710 may be formed of a polyoxymethylene (POM) material that may be used at low torque.

Meanwhile, the third gear 755 and the fourth gear 756 may be manufactured by sintering metal powder having increased strength so as to be used at high torque.

In addition, the second gear 754 may include a first gear portion 754*a* and a second gear portion 754*b*. The first gear portion 754*a* may be engaged with the first gear 753, and the second gear portion 754*b* may be engaged with the third gear 755.

Accordingly, the first gear portion 754*a* may be formed of, for example, polyoxymethylene (POM) material, and the second gear portion 745*b* may be formed of, for example, sintered metal powder.

In this case, a diameter of the first gear portion 754*a* is larger than a diameter of the second gear portion 754*b*.

After manufacturing the second gear portion 754*b*, the second gear portion 754 is manufactured by insert injection-molding the first gear portion 754*a* to surround an outer circumference of the second gear portion 754*b*.

The motor assembly 700 may further include a box cover 760 coupled to the gear box 740 and covering the power transmission part 750.

Figure 14:
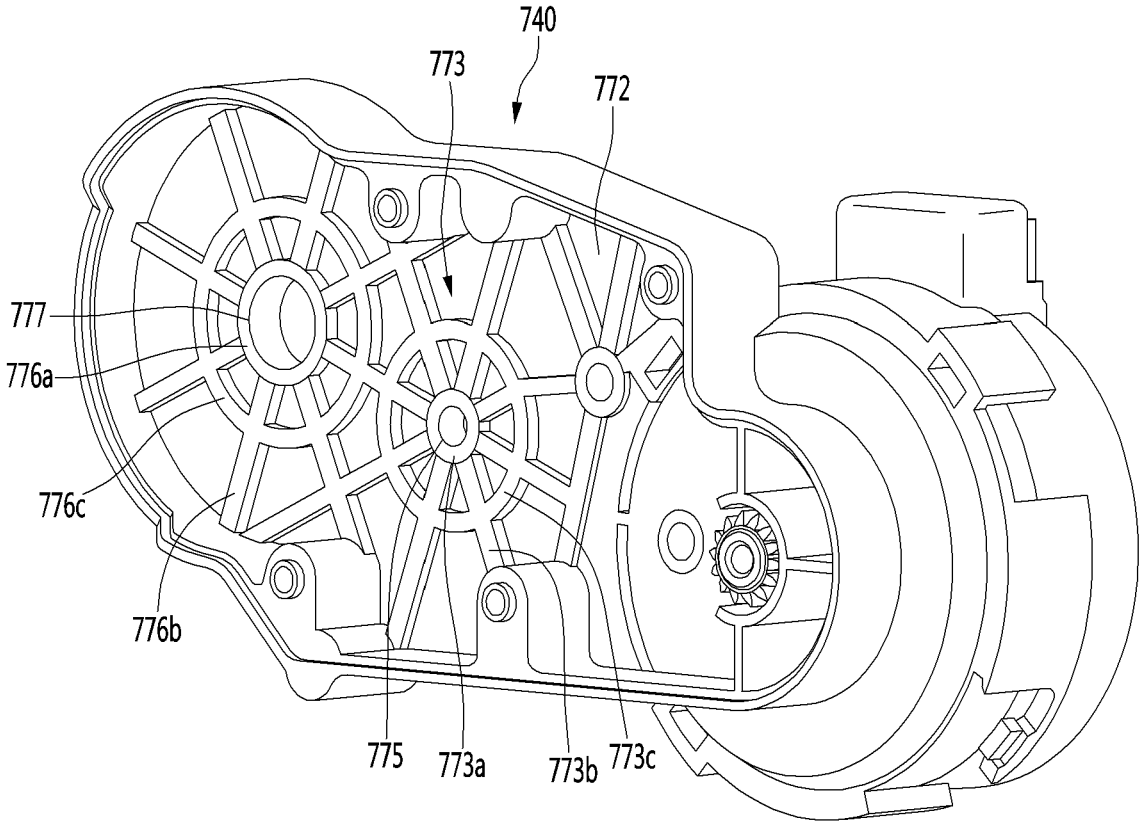
FIGS. 14 and 15 are perspective views of a gear box according to an embodiment of the present invention.
Figure 15:
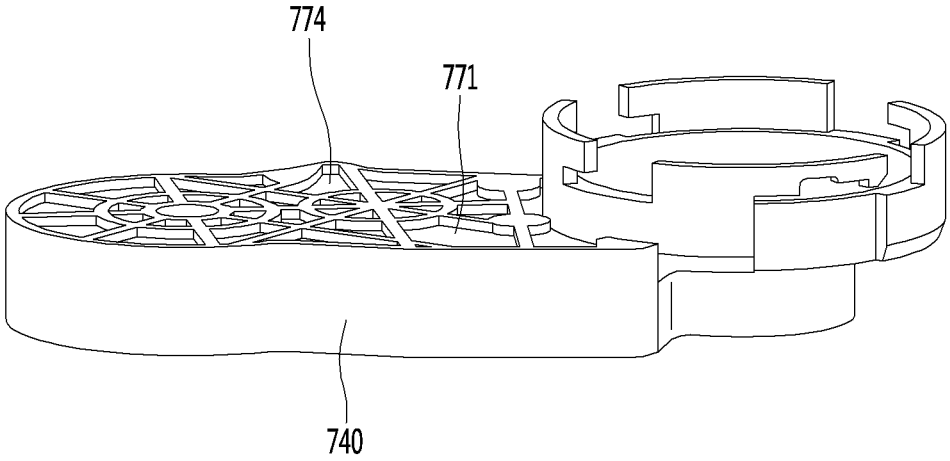

FIGS. 14 and 15 are perspective views of a gear box according to an embodiment of the present invention.

Referring to FIGS. 14 and 15, the second installation portion 747 of the gear box 740 may include a first wall 771 and a second wall 772 perpendicularly extending from an edge of the first wall 772.

In addition, the first wall 771 and the second wall 772 form a space for accommodating the power transmission part 750.

A surface forming a space in the first wall 771 that accommodates the power transmission part 750 is referred to as an inner surface, and a surface opposite to the inner surface is referred to as an outer surface.

Reinforcing ribs 773 and 774 are formed on each of the inner and outer surfaces of the first wall 771 to form strength of the first wall. That is, a first reinforcing rib 773 is formed on the inner surface of the first wall 771, and a second reinforcing rib 774 is formed on the outer surface of the first wall 771.

The reinforcing ribs 773 and 774 may protrude from the first wall 771 and may be formed in a symmetrical shape.

According to the present embodiment, when the reinforcing ribs are formed on each of the outer surface and the inner surface of the first wall 711, a thickness of one reinforcing rib may be reduced, thus preventing an increase in volume of the gear box, as compared with a case where the reinforcing rib is formed on the outer surface of the first wall 711.

Hereinafter, the first reinforcing rib 773 will be described in detail.

The reinforcing rib 773 may include a plurality of ribs.

The reinforcing rib 773 may include a first rib 773*a* having a cylindrical shape, a plurality of second ribs 773*b* extending from the first rib 773*a* in different directions, and a third rib 773*c* connecting the plurality of second ribs 773*b*.

In addition, a shaft accommodation recess 775 into which the shaft 758 of one of the plurality of gears is inserted may be formed at the first rib 773*a*. For example, the shaft 758 of the third gear 755 may be accommodated in the shaft accommodation recess 775.

According to the present embodiment, as the first rib 773*a* is formed at the shaft accommodation recess 775, damage to the gear box 740 by a force transmitted through the shaft 758 may be prevented.

For example, the plurality of second ribs 773*b* may extend radially from the first rib 773*a*. The third rib 773*c* may be formed in an arc shape to connect the plurality of second ribs 773*c*. Therefore, a line connecting the plurality of third ribs 773*c* may be formed in a circular shape.

A fourth rib 776*a* having a cylindrical shape may be formed at a position spaced apart from the first rib 773*a* on the first wall 711. The fourth rib 776*a* may have a diameter larger than the first rib 773*a*.

In addition, a plurality of fifth ribs 776*b* may extend in different directions from the fourth rib 776*a*. For example, the plurality of fifth ribs 776*b* may extend radially from the first rib 776*a*.

The plurality of fifth ribs 776*b* may be connected by a sixth rib 776*c*. The sixth rib 776*c* may be formed in an arc shape to connect the plurality of fifth ribs 776*c*. Therefore, a line connecting the plurality of sixth ribs 776*c* may be formed in a circular shape.

Some of the plurality of second ribs 773*b* may be connected to some of the plurality of fifth ribs 776*b*.

In addition, a shaft hole 777 through which a rotary shaft of the fourth gear 756 penetrates may be formed at the fourth rib 776*a*.

Figure 16:
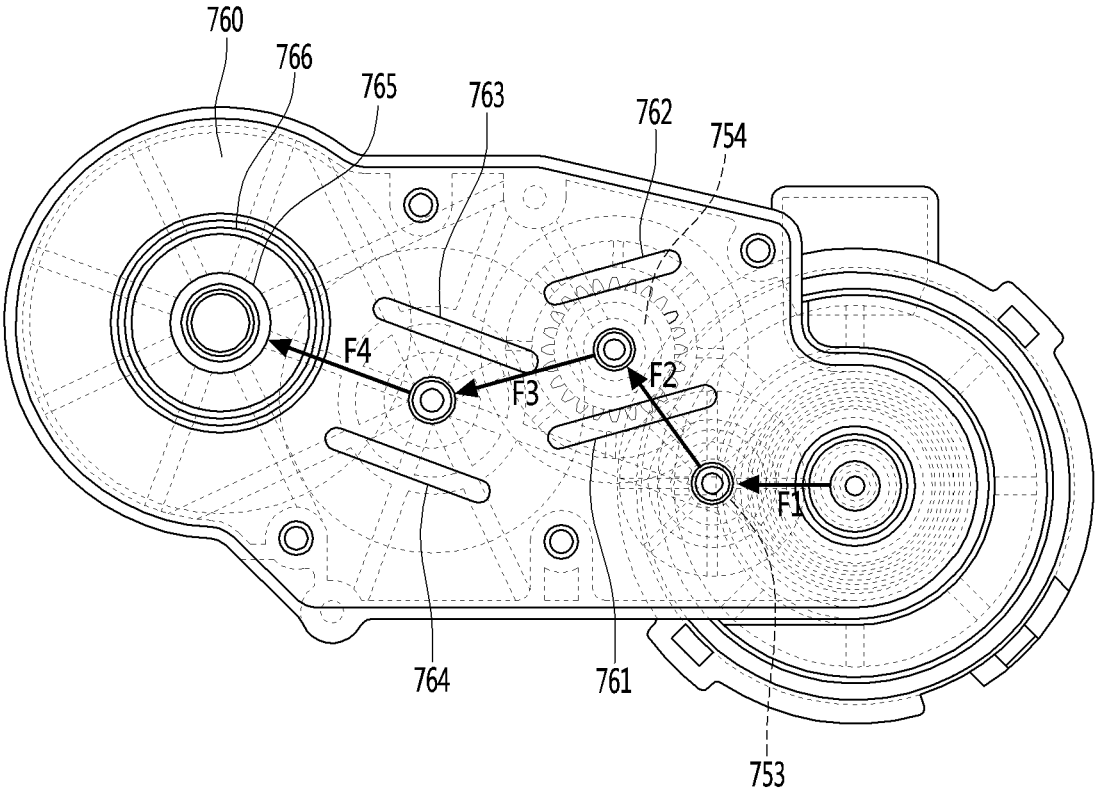
FIG. 16 is a view illustrating a box cover according to an embodiment of the present invention.

FIG. 16 is a diagram illustrating a box cover according to an embodiment.

Referring to FIGS. 10 and 16, the box cover 760 may be fastened to the second installation portion 747 in a state of covering the power transmission part 750.

The box cover 760 may be provided with a plurality of embossings for strength reinforcement. The plurality of embossings may be designed in consideration of a force transmission direction of the plurality of gears.

For example, the plurality of embossings may be formed to protrude to the outside by pressing one surface of the box cover 760.

For example, the plurality of embossings may include a first embossing 761 and a second embossing 762 extending substantially parallel to each other.

The first embossing 761 and the second embossing 762 may extend in a linear shape.

The first embossing 761 may be disposed to cross a line connecting a rotation center of the first gear 753 to a rotation center of the second gear 754.

In addition, the first embossing 761 may be located between the rotation center of the first gear 753 and the rotation center of the second gear 754.

The second embossing 762 is located farther from the first gear 753 than the first embossing 761. In addition, a rotation center of the second gear 754 may be positioned between the first embossing 761 and the second embossing 762.

The plurality of embossings may further include a third embossing 763 and a fourth embossing 764 extending substantially parallel to each other.

The third embossing 763 may be disposed to cross a line connecting a rotation center of the second gear 754 and a rotation center of the third gear 755.

In addition, a rotation center of the third gear 755 may be located between the third embossing 763 and the fourth embossing 764.

The third embossing 763 and the fourth embossing 764 may extend in parallel with a line connecting the rotation center of the third gear 755 and the rotation center of the fourth gear 756.

An extending direction of the first embossing 761 and the second embossing 762 may be perpendicular to an extending direction of the third embossing 763 and the fourth embossing 764.

The box cover 760 may include a hole 765 through which the rotation shaft of the fourth gear 756 penetrates, and the plurality of embossings may further include a fifth embossing disposed around the hole 765. That is, the hole 765 may be located in an area formed by the fifth embossing 766.

These embossings are arranged around the high torque gears to effectively prevent deformation of the box cover.

Figure 17:
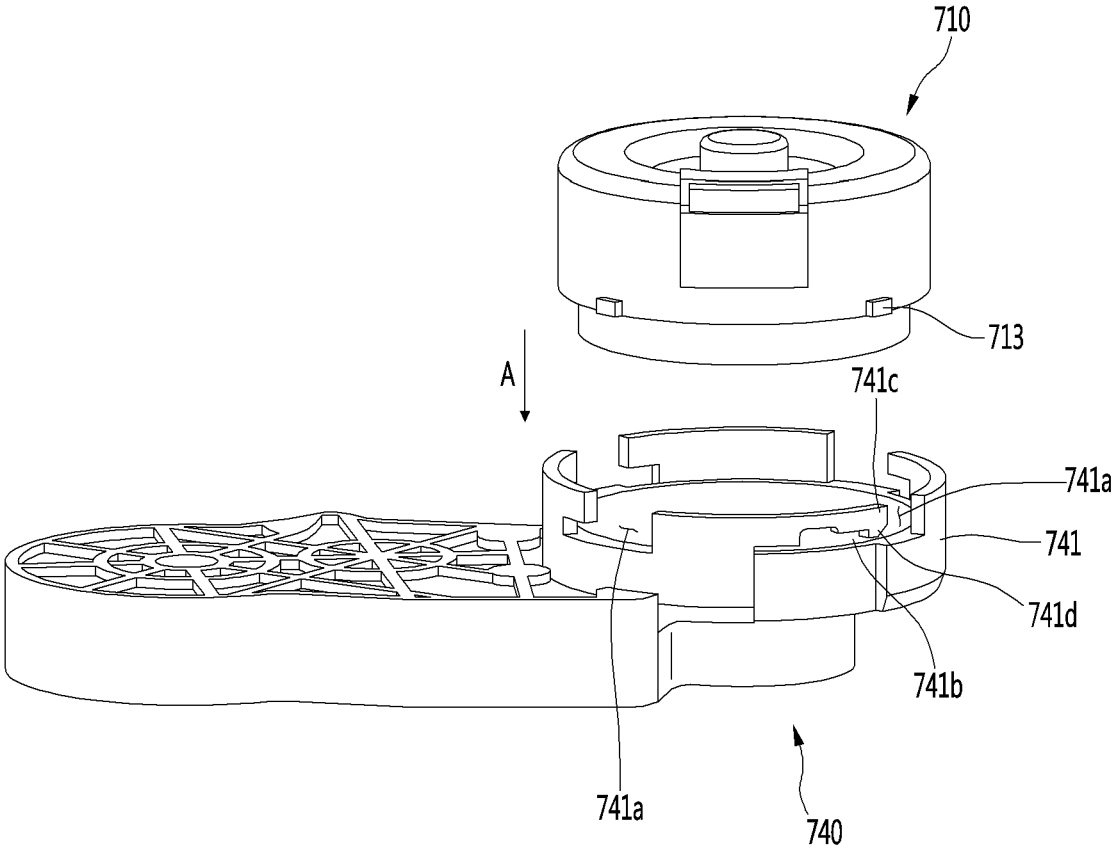
FIG. 17 is a view showing a state where a stator of a motor is detached from a gear box.
Figure 18:
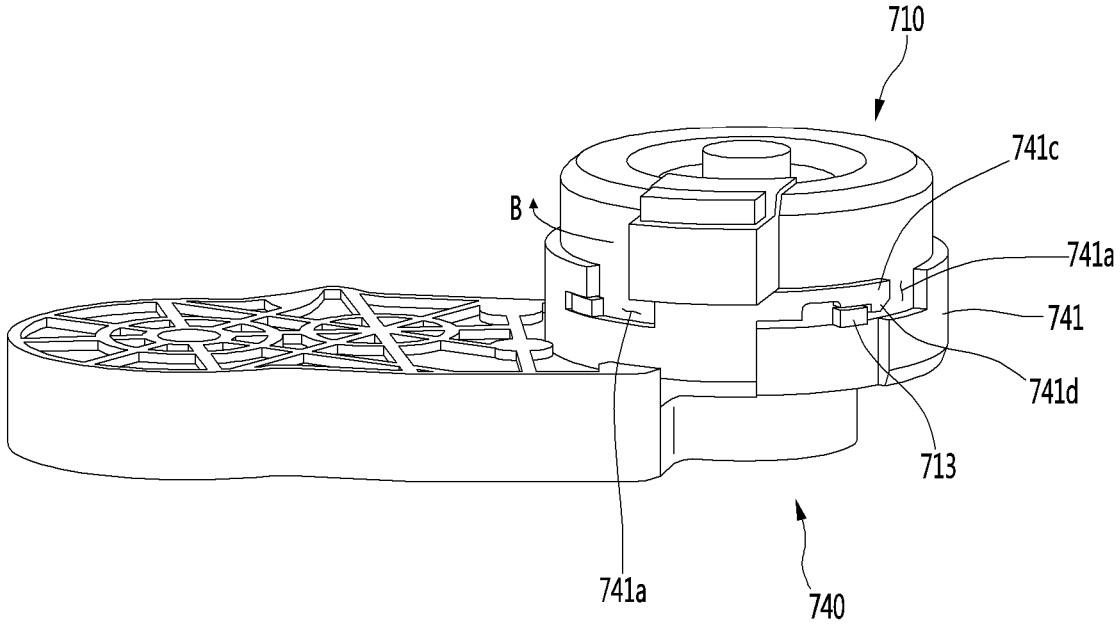
FIG. 18 is a view showing a state where a stator of a motor is coupled to a gear box.

FIG. 17 is a view showing a state where the stator of the motor is separated from the gear box, and FIG. 18 is a view showing a state where the stator of the motor is coupled to the gear box.

Referring to FIGS. 5, 17, and 18, in a state where the rotor 720 is connected to the power transmission part 750 by the shaft 715 (the rotor 720 is connected to the gear box), the stator 710 may be separated from the rotor 720 and the gear box 740. This is because, in the present embodiment, the stator 710 is a component that exists independently of the rotor 420.

In the related art, when the stator 710 needs to be replaced, the entire motor should be replaced. However, according to the present embodiment, since the stator 710 and the rotor 720 may be separated, only the stator 710 may be separated from the gear box 740 and replaced, a replacement cost may be reduced.

In order to couple the stator 710 and the gear box 740, the stator 710 may have a first coupling portion and the gear box 740 may have a second coupling portion to which the first coupling portion may be detachably coupled.

As an example, the first coupling portion may include a protrusion 713, and the second coupling portion may include a protrusion coupling portion 741*c* to which the protrusion is coupled.

For example, the protrusion 713 may protrude in a horizontal direction from the circumference of the housing 711*a*.

The protrusion coupling portion 741*c* may include a hook 741*d* to be caught by the protrusion 713.

The protrusion coupling portion 741*c* may be provided at the first installation portion 741 of the gear box 740.

In order for the protrusion 713 to be coupled to the protrusion coupling portion 741*c*, the first installation portion 741 may include slots 741*a* and 741*b* allowing the protrusion 713 to be inserted or accommodated therein. The slots 741*a* and 741*b* may be recesses or holes.

The slots 741*a* and 741*b* may include a first slot 741*a* extending in a direction parallel to a direction in which the shaft 715 extends and a second slot 741*b* extending from an end portion of the shaft 715 in a direction perpendicular to the extending direction of the shaft 715.

The first installation portion 741 may be formed, for example, in a cylindrical shape, and the second slot 741*b* may extend in a circumferential direction of the first installation portion 741. When the slots 741*a* and 741*b* are holes, the protrusion coupling portion 741*c* may be elastically deformed by the slots 741*a* and 741*b*.

Therefore, in order to couple the stator 710 to the first installation portion 741, the protrusion 713 of the stator 710 is aligned with the first slot 741*a*.

Next, the stator 710 is moved in a direction of the arrow A in the drawing so that the protrusion 713 is inserted into the first slot 741*a*.

In addition, when the protrusion 713 is aligned with the second slot 741*b* in a state where the protrusion 713 is inserted into the first slot 741*a*, the stator 710 is rotated in the direction of B (clockwise direction) in the drawing.

Then, the protrusion 713 is moved in the second slot 741*b* and the hook 741*d* of the protrusion coupling portion 741*c* is caught by the protrusion 713, so that the coupling of the stator 710 and the first installation portion 741 is completed.

The rotor 720 is accommodated in the space 712 of the stator 710 in a state where the stator 710 is coupled to the first installation portion 741.

In order to present the stator 710 from being separated from the gear box 740 due to vibration generated in the process of rotation of the rotor 710 and transmitted to the gear box 740, a plurality of protrusions 713 are provided at the stator 710 and a plurality of protrusion coupling portions 741*c* may be provided at the first installation portion 741.

For example, the plurality of protrusions 713 may be arranged in a circumferential direction of the stator 410. In addition, the plurality of protrusion coupling portions 741*c* may be arranged to be spaced apart from each other in the circumferential direction at the first installation portion 741.

In this case, some or all of the plurality of protrusion coupling portions 741*c* may include the hook 741*d*.

If the stator 710 is coupled to the gear box 740 using a fastening member such as a screw, an assembling process for coupling the stator 710 to the gear box 740 may be complicated.

In addition, since a structure for fastening the fastening member to the gear box 740 is to be formed, a volume of the gear box 740 is increased and the structure of the gear box 740 may be interfered with a peripheral component.

However, in case where the protrusion 713 is formed on the stator 710 and the protrusion coupling portion 741*c* for coupling the protrusion 713 to the gear box 740 is formed as in the present invention, the stator 710 may be easily coupled and separated and an increase in the volume of the gear box 740 may be prevented.

A height of the first installation portion 741 may be lower than that of the stator 710 so that the user may grip the stator 710 in the process of separating the stator 710 from the gear box 740.

Figure 19:
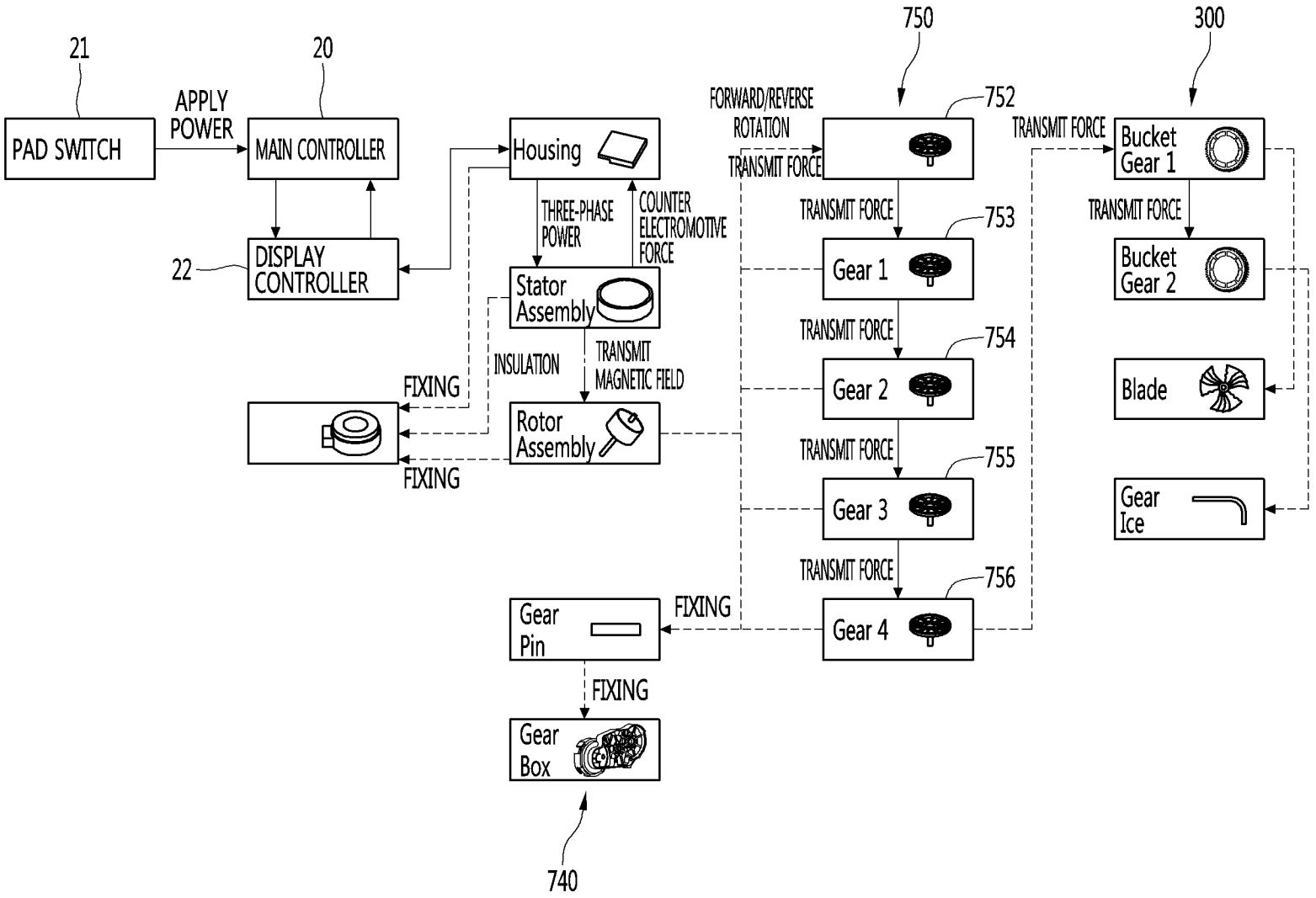
FIG. 19 is a block diagram of the refrigerator according to an embodiment.
Figure 20:
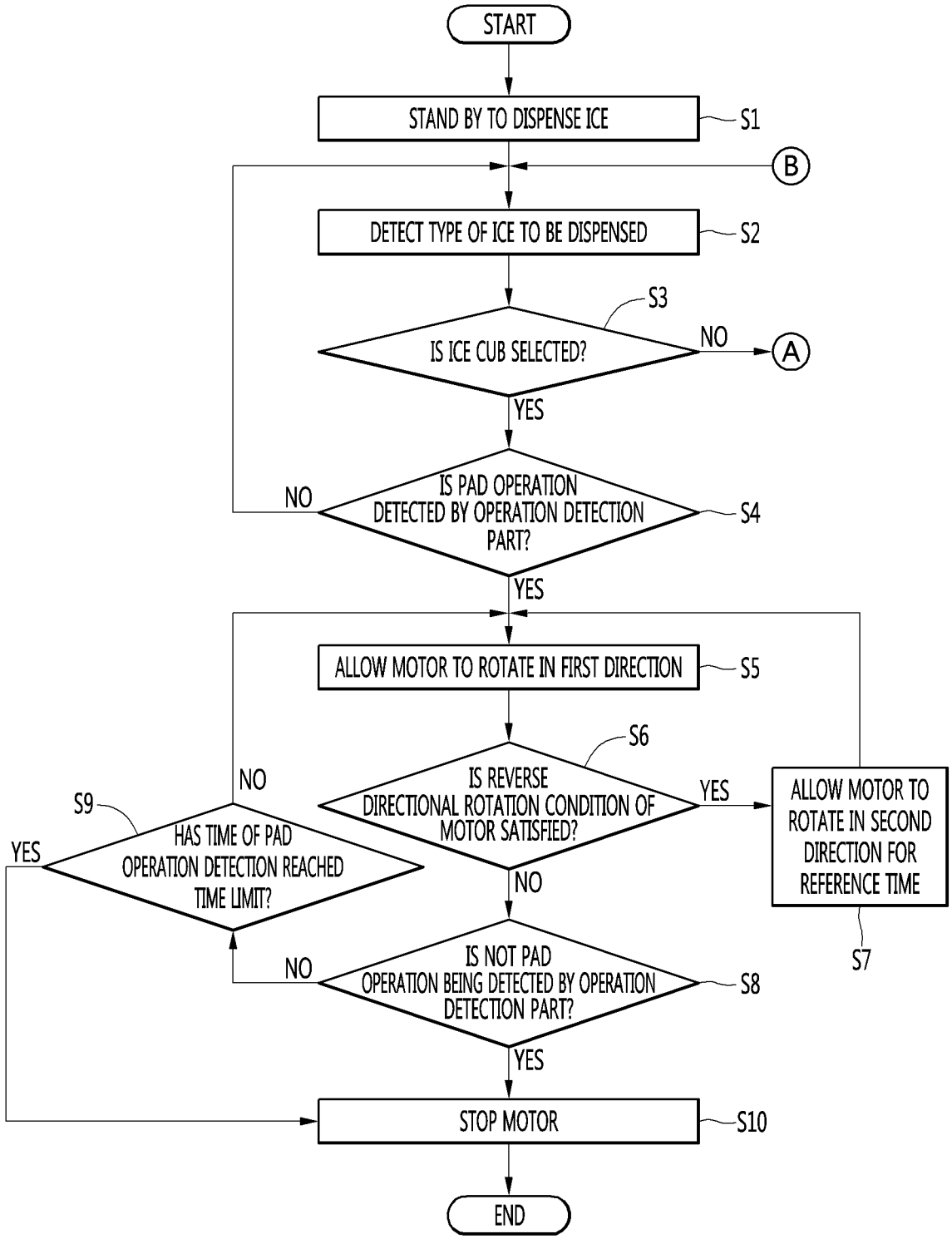
FIGS. 20 to 21 are cross-sectional views for explaining a method for controlling a motor assembly according to an embodiment of the present invention.
Figure 21:
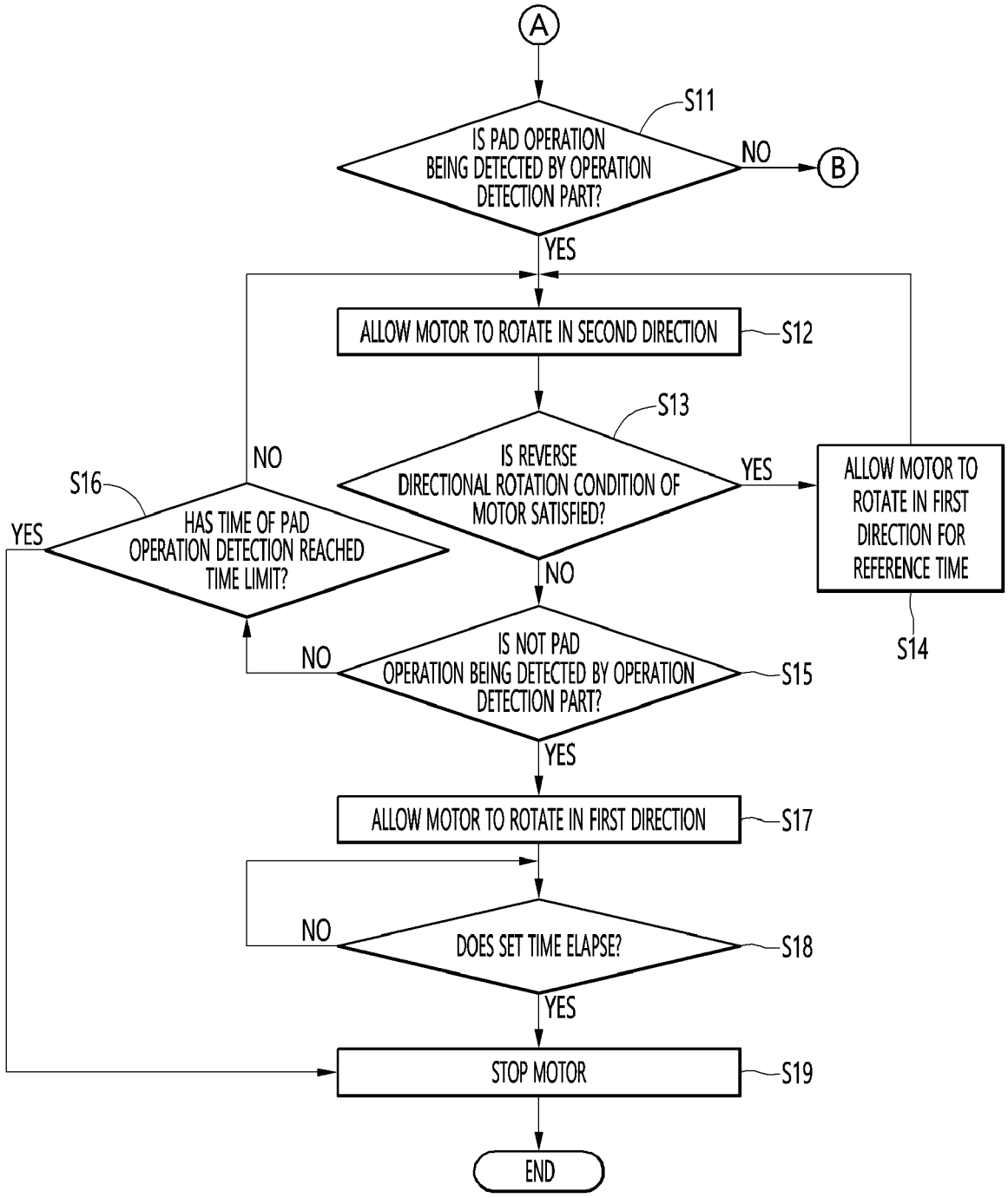

FIG. 19 is a block diagram of the refrigerator according to an embodiment, and FIGS. 20 to 21 are cross-sectional views for explaining a method for controlling the motor assembly according to an embodiment of the present invention.

First, referring to FIG. 19, the refrigerator 1 may further include a pad switch 21 (or an operation detection part) for detecting an operation of the operation pad 19. The pad switch 21 may be turned on when the operation pad 19 operates, but is not limited thereto. The operation pad 19 may generate a driving command for the motor 710.

The refrigerator 1 may include a main controller 20 that controls the motor 710 based on the detection information of the pad switch 21 and ice type information input from the input part 18. Also, the refrigerator 1 may further include a display controller 22 that controls a display of the refrigerator door. The display controller 22 is electrically connected to the main controller 20 to receive a control signal of the motor 710 from the main controller 20 and apply power to the motor 710.

The display controller 22 may detect the counter electromotive force generated during the operation of the motor 710 and transmit information on the counter electromotive force to the main controller 20. Accordingly, the display controller 22 may be called a counter electromotive force detection part.

In this embodiment, the main controller 20 and the display controller 22 will be collectively referred to as a controller.

Next, referring to FIGS. 20 and 21, when the refrigerator 1 is turned on, ice is generated in the ice maker 210, and the generated ice is stored in the ice bin 300. Then, the refrigerator 1 stands by the dispensing of the ice (S1).

The user may select the type of ice to be dispensed through the input part 18, and the controller may detect the type of ice to be dispensed (S2).

The controller may determine whether ice cubes are selected (S3).

If the controller determines that the ice cubes are not selected, the controller may determine that ice pieces are selected.

Also, the controller may determine whether the operation of the operation pad 19 is detected by the pad switch 21 (S4).

As a result of the determination in operation S4, when it is determined that the operation of the operation pad 19 is detected by the pad switch 21, the controller may allow the motor 710 to rotate in a first direction so that the ice cubes are dispensed from the dispenser 17 (S5).

In the above, it has been described that the controller first determines the type of ice to be dispensed and then determines whether the operation of the operation pad 19 is detected by the pad switch 21, but vice versa.

That is, when it is determined that the operation of the operation pad 19 is detected by the pad switch 21, the controller may determine the kind of ice to be dispensed, and a rotation direction of the motor 710 may be determined according to the kind of ice to be dispensed.

When the motor 710 rotates in the first direction, power of the motor 710 may be transmitted to the plurality of rotary blades 410 so that the plurality of rotary blades 410 rotate in the same direction as the motor 710 or in a direction that is opposite to the rotation direction of the motor 710.

Hereinafter, for example, when the motor 710 rotates in the first direction, it will be assumed that the plurality of rotary blades 410 rotate in a clockwise direction in FIG. 7.

In addition, when the motor 710 rotates in a second direction that is opposite to the first direction, it will be assumed that the plurality of rotary blades 410 rotate in a counterclockwise direction in FIG. 7.

When the plurality of rotary blades 410 rotate in the clockwise direction, the ice cubes may move toward the discharge part 500 by the plurality of rotary blades 410 and be discharged from the ice bin through the discharge holes 510. The ice to be discharged from the ice bin 300 may pass through the ice duct 150 and be discharged from the dispenser 17.

The controller may determine whether a reverse rotation condition of the motor 710 is satisfied while the motor 710 rotates in the first direction (S6).

A case in which the reverse rotation condition of the motor 710 is satisfied may be a case in which the load applied to the motor 710 is large so that the motor 710 does not rotate smoothly, or the rotary blade 410 does not contact the ice. In this case, the ice may not be smoothly discharged from the ice bin 300.

The controller may determine whether the reverse rotation condition of the motor 710 is satisfied based on a pulse signal output from the motor 710.

When the motor 710 rotates in the state in which the load is not applied to the motor 710 (in a no load state), the number of pulses output from the motor 710 per unit time may be N.

Also, when the rotary blade 410 rotates in the state of contacting the ice, the number of pulses output from the motor 710 may be less than N.

When the number of pulses output from the motor 710 per unit time is equal to N or more than an upper limit that is less than N, the controller may recognizes that the rotary blade 410 is in an idle state to determine that the reverse rotation condition is satisfied.

Also, as the load applied to the rotary blade 410 increases, the number of pulses output from the motor 710 decreases.

When the number of pulses output from the motor 710 is less than or equal to the lower limit, the controller may determine that the reverse rotation condition of the motor 710 is satisfied. At this time, the number of lower limit is greater than 0. Although not limited, the number of lower limit may be set to a value of ¼ or less of the N.

As a result of the determination in operation S6, when the reverse rotation condition of the motor 710 is satisfied, the controller allows the motor 710 to rotate for a reference time in the second direction that is opposite to the first direction (S7).

When the motor 710 rotates in the second direction, the ice in the ice bin 300 may be rearranged. When the ice is rearranged, possibility of discharge of the ice may increase by the rotary blades 410. The ice may contact the rotary blade 410, or the load applied to the rotary blade 410 may be reduced.

In this embodiment, a process of allowing the motor 710 to rotate in the reverse direction may be referred to as rearrangement of ice.

After the motor 710 rotates in the second direction for a reference time, the motor 710 rotates again in the first direction.

As a result of the determination in operation S6, when the reverse rotation condition of the motor 710 is not satisfied, the controller determines whether the operation of the operation pad 19 is not detected by the pad switch 21 (S8).

The motor 710 may operate while the operation of the operation pad 19 is detected by the pad switch 21.

If the user does not allow the operation pad 19 to operate, the operation of the operation pad 19 is not detected by the pad switch 21.

Therefore, when it is determined that the operation of the operation pad 19 is not detected by the pad switch 21, the controller stops the motor 710 (S10).

On the other hand, as a result of the determination in operation S8, when the operation of the operation pad 19 is detected by the pad switch 21, it may be determined whether a pad operation detection time has reached a time limit (S9).

For example, even though the operation of the operation pad 19 is released after the operation of the operation pad 19 due to malfunction or failure of the pad switch 21, the operation of the operation pad 19 may be detected by the pad switch 21.

In this case, since the motor 710 continuously rotates, power may be unnecessarily consumed, and thus, the motor 710 may be damaged.

Therefore, in this embodiment, in order to prevent the continuous rotation of the motor 710, when it is determined that the pad operation detection time has reached the time limit, the controller stops the motor 710. Although not limiting, the time limit may be set to 3 minutes.

If it is determined in operation S3 that the ice cubes are not selected, the controller determines that the ice pieces are selected.

Also, the controller may determine whether the operation of the operation pad 19 is detected by the pad switch 21 (S11).

As a result of the determination in operation S11, when it is determined that the operation of the operation pad 19 is detected by the pad switch 21, the controller may allow the motor 710 to rotate in the second direction so that the ice pieces are dispensed from the dispenser 17 (S12).

In the above, it has been described that the controller first determines the type of ice to be dispensed and then determines whether the operation of the operation pad 19 is detected by the pad switch 21, but vice versa. That is, when it is determined that the operation of the operation pad 19 is detected by the pad switch 21, the controller may determine the kind of ice to be dispensed, and a rotation direction of the motor 710 may be determined according to the kind of ice to be dispensed.

When the motor 710 rotates in the second direction, the power of the motor 710 is transmitted to the plurality of rotary blades 410 to rotate in the counterclockwise direction in FIG. 7.

When the plurality of rotary blades 410 rotate in the counterclockwise direction, the ice is crushed by an interaction of the plurality of rotary blades 410 and a plurality of fixed blades 480, the crushed pieces of ice may be discharged from the ice bin 300 through the discharge hole 510.

In addition, the ice pieces discharged from the ice bin 300 may pass through the ice duct 150 and be discharged from the dispenser 17.

The controller may determine whether the reverse rotation condition of the motor 710 is satisfied while the motor 710 rotates in the first direction (S13).

Since the determination condition in operation S13 is the same as the determination condition in operation S6, detailed description thereof will be omitted.

As a result of the determination in operation S13, when the reverse rotation condition of the motor 710 is satisfied, the controller allows the motor 710 to rotate for the reference time in the first direction (S14). When the motor 710 rotates in the first direction, the ice in the ice bin 300 may be rearranged. When the ice is rearranged, possibility of crush and discharge of the ice may increase by the rotary blades 410.

In this embodiment, a process of allowing the motor 710 to rotate in the reverse direction may be referred to as rearrangement of ice.

After the motor 710 rotates in the first direction for a reference time, the motor 710 rotates again in the second direction.

As a result of the determination in operation S13, when the reverse rotation condition of the motor 710 is not satisfied, the controller determines whether the operation of the operation pad 19 is not detected by the pad switch 21 (S15).

As a result of the determination in operation S15, when the operation of the operation pad 19 is detected by the pad switch 21, it may be determined whether the pad operation detection time has reached a time limit (S16).

As a result of the determination in operation S16, when it is determined that the pad operation detection time has reached the time limit, the controller stops the motor 710.

On the other hand, if it is determined that the operation of the operation pad 19 is not detected by the pad switch 21, the controller allows the motor 710 in the first direction so as to rearrange the ice within the ice bin 300 (S17).

Also, when the time for which the motor 710 rotates in the first direction elapses a set time (S18), the controller stops the motor 710 (S19).

After the discharge of the ice pieces from the ice bin 300 is completed as in this embodiment, if the motor 710 rotates for a predetermined time in the reverse direction (first direction) without stopping immediately, the ice may be rearranged in the ice bin 300.

When the ice is rearranged in the ice bin 300, the load applied to the motor 710 may be reduced so that the torque of the motor 710 is reduced when the next ice pieces are dispensed.

For another example, in operation S13, when it is determined that the reverse rotation condition of the motor 710 is satisfied, the controller may stop the motor 710 without rotating in the direction that is opposite to the first direction.

In this state, when the operation of the operation pad 19 is not detected by the pad switch 21, the controller may allow the motor 710 to rotate in the first direction so as to rearrange the ice. After the motor 710 rotates in the first direction for the reference time, the motor 710 may be stopped again.

The invention claimed is:

1. A refrigerator comprising:

an ice maker configured to generate ice;

an ice bin configured to store the ice generated in the ice maker, the ice bin comprising a rotary blade that rotates to discharge the ice;

a brushless direct current (BLDC) motor configured to generate power for allowing the rotary blade to rotate so that ice pieces or ice cubes are dispensed from the ice bin by forward and reverse rotation of the BLDC motor;

a counter electromotive force detection part configured to detect a counter electromotive force generated while the BLDC motor is driven;

an operation pad configured to generate a driving command for the BLDC motor;

an operation detection part configured to detect an operation of the operation pad;

an input part configured to receive a selection of the ice cubes or the ice pieces; and a controller configured to receive a signal from the counter electromotive force detection part so as to determine a restriction of the BLDC motor, the controller being configured to control the BLDC motor so that the BLDC motor reversely rotates to release the restriction of the BLDC when it is determined that the BLDC motor is restricted, wherein the controller is configured to operate the BLDC motor to dispense the ice pieces or the ice cubes when the operation of the operation pad is detected, wherein the controller is configured to determine whether the operation of the operation pad is not detected when the restriction of the BLDC motor is not detected, and wherein, when the ice pieces are selected through the input part, the controller is configured to control the BLDC motor so that the BLDC motor rotates in a second direction, when the restriction of the BLDC motor is not detected, determine whether the operation of the operation pad is detected while the ice pieces are being dispensed, and when the operation of the operation pad is no longer detected the controller controls the BLDC motor to rotate in the first direction, and wherein, when the ice cubes are selected through the input part, the controller is configured to:

control the BLDC motor to rotate in a first direction, when the restriction of the BLDC motor is not detected, determine whether the operation of the operation pad is no longer being detected while the ice cubes are being dispensed, and when the operation of the operation pad is no longer detected, the controller stops the BLDC motor.

2. The refrigerator of claim 1, wherein the controller is configured to control the BLDC motor so that the BLDC motor is stopped when the restriction of the BLDC motor is detected in the state in which the operation of the operation pad is detected.

3. The refrigerator of claim 1, wherein, when a time at which the operation of the operation pad is detected by the operation detection part reaches a time limit while the BLDC motor operates, the controller is configured to stop the BLDC motor.

4. The refrigerator of claim 1, wherein the controller is configured to stop the BLDC motor after allowing the BLDC motor to rotate for a set time when the operation of the operation pad is no longer detected by the operation detection part while the ice pieces are dispensed.

5. A method for controlling a refrigerator, comprising:

controlling, by a controller when ice pieces are selected through an input part and an operation of an operation pad is detected by an operation detection part, a brushless direct current (BLDC) motor so that the BLDC motor rotates in a second direction to dispense the ice pieces;

determining whether a restriction of the BLDC motor occurs while the BLDC motor rotates in the second direction;

stopping the BLDC motor when the restriction of the BLDC motor occurs;

determining whether the operation of the operation pad is no longer detected by the operation detection part when the restriction of the BLDC motor is not detected while the BLDC motor rotates in the the second direction; and controlling, by the controller, the BLDC motor so that the BLDC motor rotates in a first direction that is opposite to the second direction for a set time when the restriction of the BLDC motor does not occur and the operation of the operation pad is no longer detected by the operation detection part while the ice pieces are being dispensed, wherein the method further comprises:

when ice cubes are selected through the input part, controlling, by the controller, the BLDC motor so that the BLDC motor rotates in the first direction when the operation of the operation pad is detected to dispense the ice cubes, determining whether the operation of the operation pad is no longer being detected by the operation detection part while after the ice cubes are being dispensed, and controlling, by the controller, the BLDC motor so that the BLDC motor is stopped when the operation of the operation pad is no longer detected by the operation detection part while the ice cubes are being dispensed.

6. A refrigerator comprising:

an ice maker configured to generate ice;

an ice bin configured to store the ice generated in the ice maker, the ice bin comprising a rotary blade that rotates to discharge the ice;

a motor configured to generate power for allowing the rotary blade to rotate;

an operation pad configured to operate so that ice is discharged from the ice bin;

an operation detection part configured to detect the operation of the operation pad;

an input part configured to select ice cubes or ice pieces; and a controller configured to control the motor when the operation of the operation pad is detected by the operation detection part, wherein when the ice pieces are selected through the input part:

the controller is configured to control the motor so that the motor rotates in a second direction to discharge the ice pieces when the operation of the operation pad is detected by the operation detection part, the operation detection part is configured to determine when the operation of the operation pad is no longer being detected while the motor rotates in the second direction to discharge the ice pieces, and the controller is configured to control the motor so that the motor rotates in a first direction that is opposite to the second direction for a set time when the operation of the operation pad is no longer detected by the operation detection part while the ice pieces are being discharged, and wherein when the ice cubes are selected through the input part" has been changed to:

the controller is configured to control the motor so that the motor rotates in the first direction to discharge the ice cubes when the operation of the operation pad is detected, the operation detection part is configured to determine when the operation of the operation pad is no longer being detected while the motor rotates in the first direction to discharge the ice cubes, and the controller is configured to stop the motor when the operation of the operation pad is no longer detected by the operation detection part while the ice cubes are being discharged.

7. The refrigerator of claim 6, wherein the controller determines whether reverse rotation conditions of the motor are satisfied while the motor rotates in the one direction to discharge the ice, and when it is determined that the reverse rotation conditions of the motor are satisfied, the controller is configured to control the motor so that the motor rotates again in the one direction after rotating in the other direction for a reference time when it is determined that the reverse rotation conditions of the motor are satisfied.

8. The refrigerator according to claim 7, wherein the motor comprises a brushless direct current (BLDC) motor, and when the number of pulses output from the motor per unit time is N in a state in which a load is not applied to the motor, if the reverse rotation conditions of the motor are satisfied, the number of pulses output from the motor per unit time is N or more than an upper limit that is less than N.

9. The refrigerator of claim 7, wherein the motor comprises a brushless direct current (BLDC) motor, and when the number of pulses output from the motor per unit time is N in a state in which a load is not applied to the motor, if the reverse rotation conditions of the motor are satisfied, the number of pulses output from the motor per unit time is less than a lower limit that is less than N.

10. The refrigerator of claim 6, wherein, when a time at which the operation of the operation pad is detected by the operation detection part reaches a time limit while the motor operates, the controller is configured to stop the motor.

11. The refrigerator of claim 1, wherein the operation pad is an input device configured to receive an ice dispensing command.

12. The refrigerator of claim 1, wherein the operation detection part is a pad switch that is turned on when the operation pad is operated.

13. The refrigerator of claim 1, wherein when the ice pieces are selected through the input part, the controller is configured to control the BLDC motor so that the BLDC motor reversely rotates to rearrange the ice within the ice bin to reduce torque applied to a motor after ice pieces are dispensed.

* * * * *